US009482497B2

(12) United States Patent
Schneider

(10) Patent No.: US 9,482,497 B2
(45) Date of Patent: Nov. 1, 2016

(54) CORNER-MOUNTED TARGET

(71) Applicant: Paul W. Schneider, Oconomowoc, WI (US)

(72) Inventor: Paul W. Schneider, Oconomowoc, WI (US)

(73) Assignee: RIFIT WORLD, LLC, Milwaukee, WI (US)

( * ) Notice: Subject to any disclaimer, the term of this patent is extended or adjusted under 35 U.S.C. 154(b) by 151 days.

(21) Appl. No.: 14/028,141

(22) Filed: Sep. 16, 2013

(65) Prior Publication Data

US 2014/0091527 A1 Apr. 3, 2014

Related U.S. Application Data

(60) Provisional application No. 61/701,241, filed on Sep. 14, 2012.

(51) Int. Cl.

| | |
|---|---|
| ***A63B 63/00*** | (2006.01) |
| ***F41J 1/10*** | (2006.01) |
| ***F41J 3/00*** | (2006.01) |
| *A63B 63/08* | (2006.01) |

(52) U.S. Cl.

CPC ..... *F41J 1/10* (2013.01); *F41J 3/0019* (2013.01); *A63B 63/00* (2013.01); *A63B 63/083* (2013.01)

(58) Field of Classification Search

CPC ..... A63B 63/00; A63B 2063/001; A63B 2063/003; A63B 57/40; A63B 67/06; A63B 69/3676; A63B 9/0204; F41J 1/10; F41J 3/0019

USPC ..... 273/398–402, 395, 396, 407; 473/476–478, 431–435, 173–185, 481

See application file for complete search history.

(56) References Cited

U.S. PATENT DOCUMENTS

| | | | | | |
|---|---|---|---|---|---|
| 2,383,866 | A * | 8/1945 | Kling | A63B 57/357 | 273/127 B |
| 2,575,530 | A * | 11/1951 | Reid | A47B 67/02 | 312/199 |
| 3,088,738 | A * | 5/1963 | Meyer | F41J 3/0004 | 206/45.2 |
| 3,580,578 | A * | 5/1971 | McCarthy | A63B 67/002 | 273/401 |
| 3,599,976 | A * | 8/1971 | Krajac, Jr. | A63F 7/305 | 273/317.3 |
| 3,817,528 | A * | 6/1974 | Stuhler | F41J 1/10 | 273/393 |
| 4,022,472 | A * | 5/1977 | Seals | A63F 9/0204 | 273/400 |
| 4,036,494 | A * | 7/1977 | Hayes | A63B 63/083 | 16/259 |
| 4,373,734 | A * | 2/1983 | Frank | A63B 67/00 | 273/401 |
| 4,667,964 | A * | 5/1987 | Hickey | A63B 67/02 | 473/172 |
| 4,919,436 | A * | 4/1990 | Buselli | A63F 9/0208 | 273/348.4 |
| 5,015,276 | A * | 5/1991 | Hedberg | F26B 21/083 | 34/81 |
| 5,080,355 | A * | 1/1992 | Offutt | A63B 63/083 | 473/481 |
| 5,280,919 | A * | 1/1994 | Graham | F41J 1/01 | 273/381 |
| 5,306,013 | A * | 4/1994 | Germinario | A63B 24/0021 | 473/182 |

(Continued)

*Primary Examiner* — Mark Graham

(74) *Attorney, Agent, or Firm* — Boyle Fredrickson, S.C.

(57) ABSTRACT

A target for receiving projectiles is configured for mounting in a corner of a room. The target includes a front target wall including a pair of spaced apart edges having a target area located between the edges and at least one side area extending from the front wall adapted for engagement with one of the walls defining the corner.

10 Claims, 24 Drawing Sheets

(56) References Cited

U.S. PATENT DOCUMENTS 5,332,230 A * 7/1994 Benedict ..... A63B 67/06 273/400
5,536,017 A * 7/1996 Salisian ..... A63F 9/0204 273/375
5,611,531 A * 3/1997 Skerlan ..... A63B 63/00 273/389
D407,764 S * 4/1999 Ashton ..... D21/303
5,944,318 A * 8/1999 Payton ..... A63B 63/00 273/402
6,398,661 B1 * 6/2002 Llewellyn ..... A63B 63/00 473/180
6,679,498 B2 * 1/2004 Barniak, Jr. ..... A63B 21/0552 273/317.3
7,100,921 B2 * 9/2006 Yercha ..... A63B 67/06 273/348.4
7,281,999 B1 * 10/2007 Miller ..... A63B 63/083 473/481
2008/0032827 A1 * 2/2008 Behrend ..... A63B 69/002 473/446
2008/0096695 A1 * 4/2008 Winningham ..... A63B 63/004 473/435
2008/0261727 A1 * 10/2008 Snyder ..... A63B 24/0021 473/435
2012/0193873 A1 * 8/2012 Sindaco ..... A63B 63/00 273/400

* cited by examiner

Fig. 20
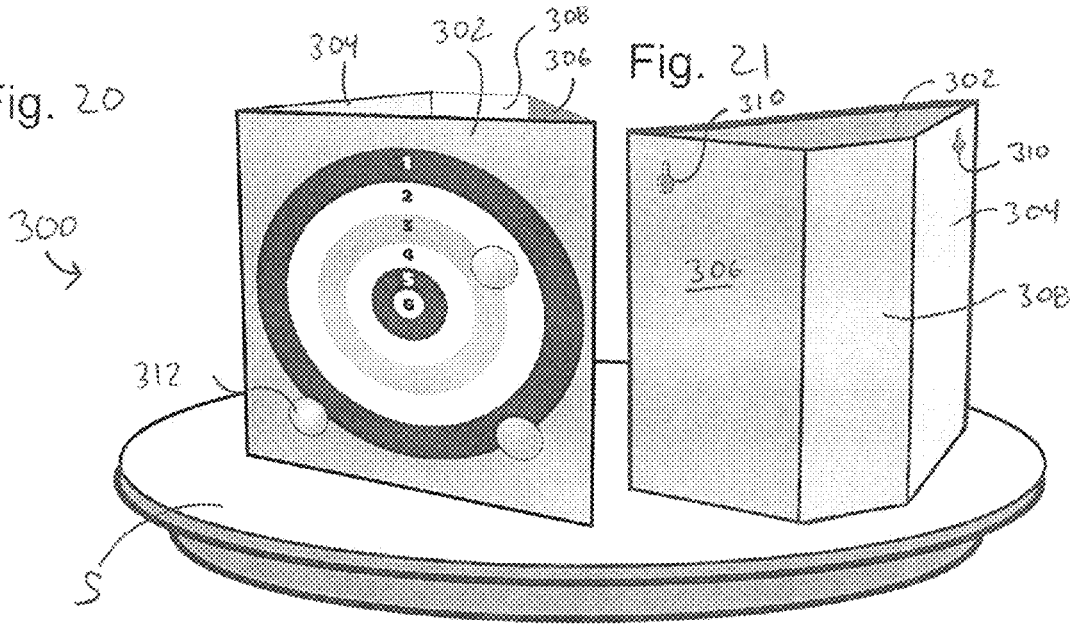
Fig. 21
Fig. 22
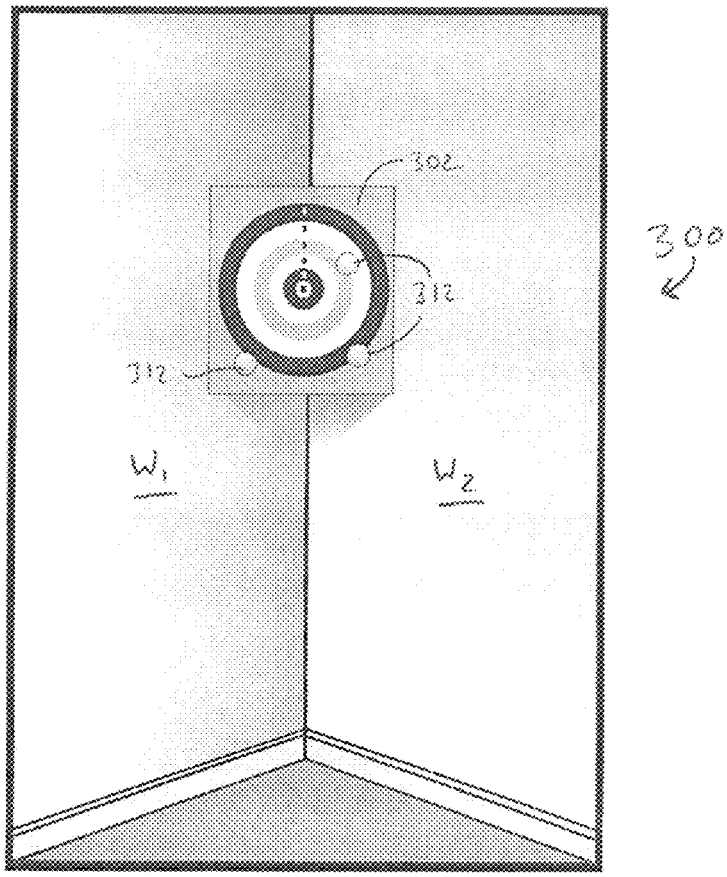

Fig. 23
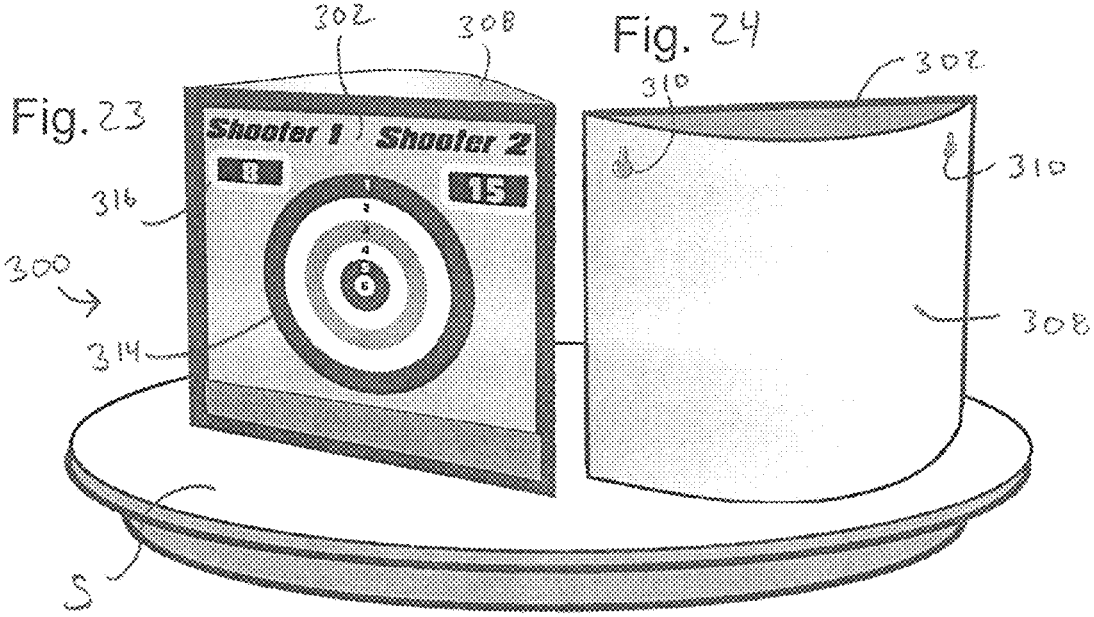
Fig. 24
Fig. 25
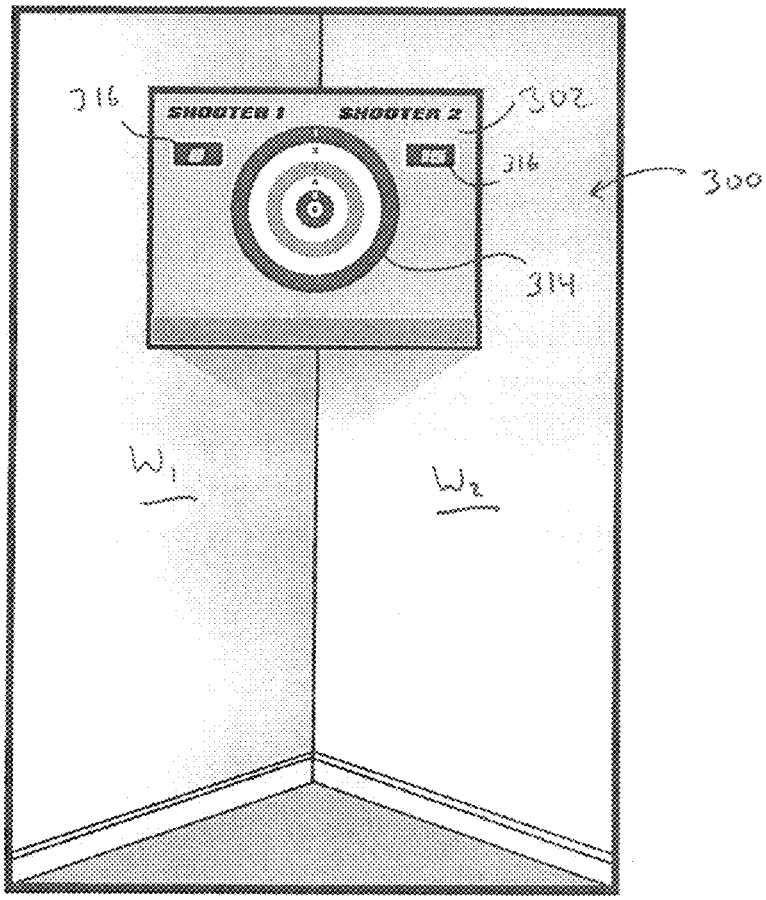

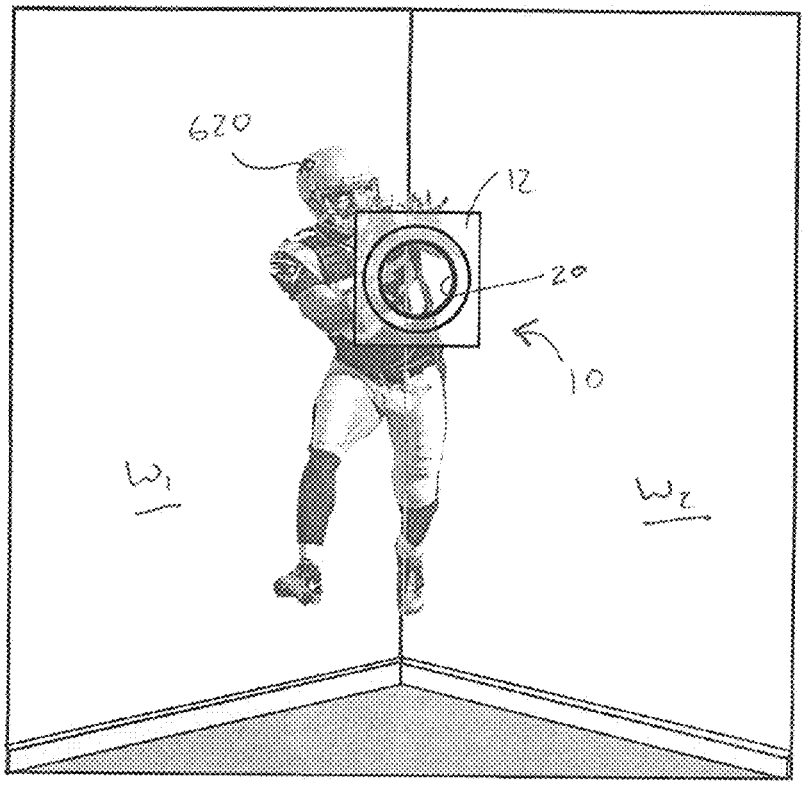
Fig. 38
Fig. 39
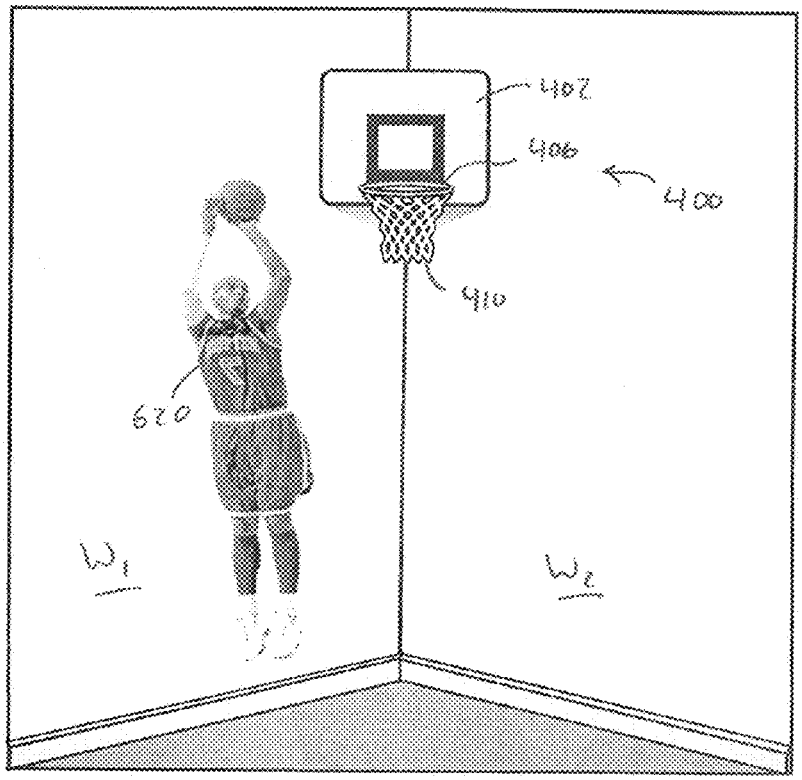

Fig. 40
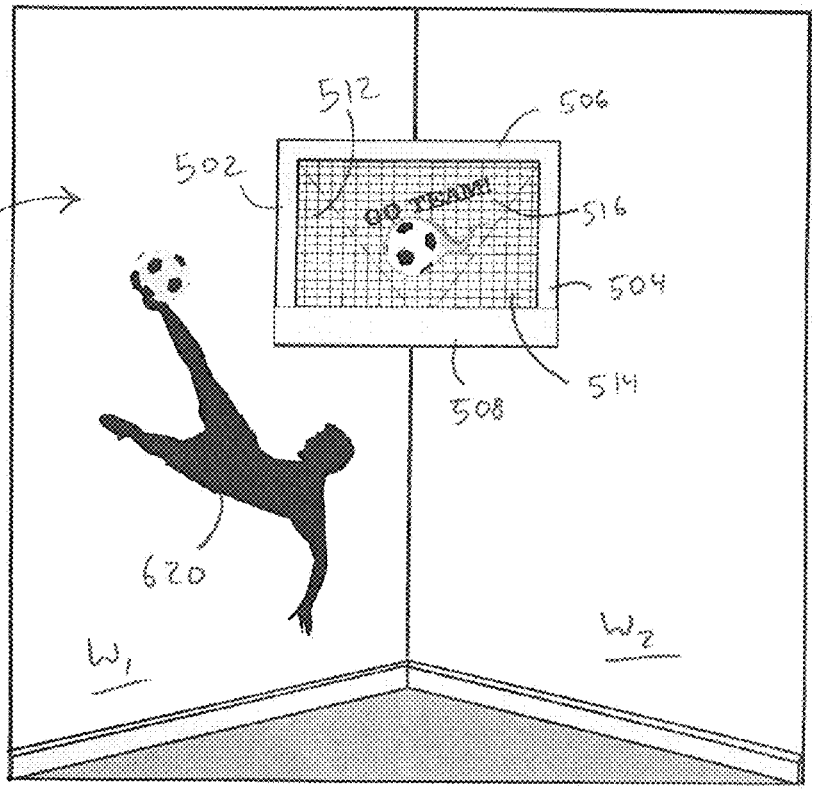
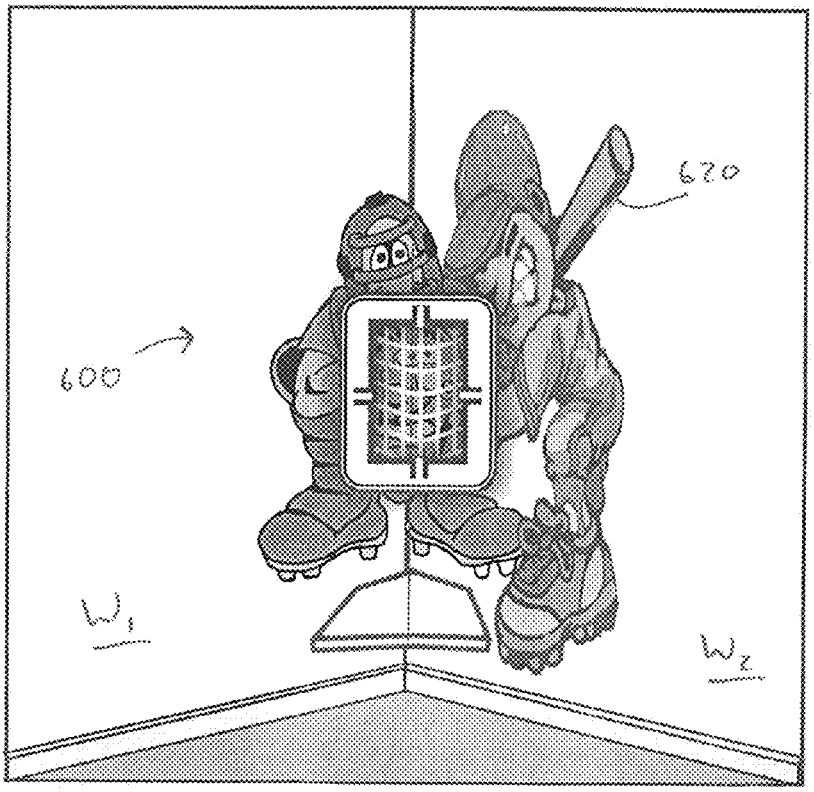
Fig. 41

CORNER-MOUNTED TARGET

CROSS-REFERENCE TO RELATED APPLICATIONS

This application claims priority to U.S. provisional application Ser. No. 61/701,241, filed Sep. 14, 2012, the entire contents of which is incorporated herein by reference.

BACKGROUND OF THE INVENTION

This invention relates to games, toys and the like, and more particularly to a target for receiving a flying projectile toy.

Small projectile such as balls, darts and flying disks are popular indoor toys amongst children and adults. Providing a target for these projectile toys provides an additional level of complexity and challenge to their enjoyment. While prior targets have allowed individuals to direct small projectile toys in an intended direction, they often result in undesirable ricochet or rebounding. Furthermore, often such targets need to be reset after usage. Accordingly there is need for a projectile toy target that limits ricochet or rebounding of the toy. There is also need for a projectile toy target that does not require resetting after engagement or contact by a toy projectile.

SUMMARY OF THE INVENTION

The present invention is generally directed to a target for receiving projectiles. The target is configured for mounting in a corner of a room. The target includes a front target wall including a pair of spaced apart edges having a target area located between the edges and at least one side area extending from the front wall adapted for engagement with one of the walls defining the corner.

In one embodiment, the target may also be mounted upright on a horizontal surface.

In one aspect, the target is configured to confine the ricochet of projectiles near the location of the target.

In another aspect, the target may be shipped in a flat orientation and subsequently erected into a folded orientation.

In another embodiment, the target may retain projectiles in an interior volume located within the target.

BRIEF DESCRIPTION OF THE DRAWINGS

The drawings illustrate the best mode presently contemplated for carrying out the invention.

In the drawings:

FIG. 20 is a front isometric view of an alternative target in accordance with the present invention;

FIG. 21 is a rear isometric view of a target of FIG. 20;

FIG. 22 is a front elevation view of a target of FIG. 20 mounted in a corner of a room;

FIG. 23 is a front isometric view of an alternative embodiment of a target of FIG. 21);

FIG. 24 is a rear isometric view of a target of FIG. 23;

FIG. 25 is a front elevation view of a target of FIG. 23 mounted in a corner of a room;

FIG. 38 is a front elevation view of an alternative embodiment of a target in accordance with the present invention mounted in a corner of a room;

FIG. 39 is an alternative front elevation view of a target of FIG. 29 mounted in a corner of a room;

FIG. 40 is an alternative front elevation view of a target of FIG. 32 mounted in a corner of a room;

FIG. 41 is an alternative front elevation view of a target of FIG. 35 mounted in a corner of a room;

DETAILED DESCRIPTION

Figure 1:
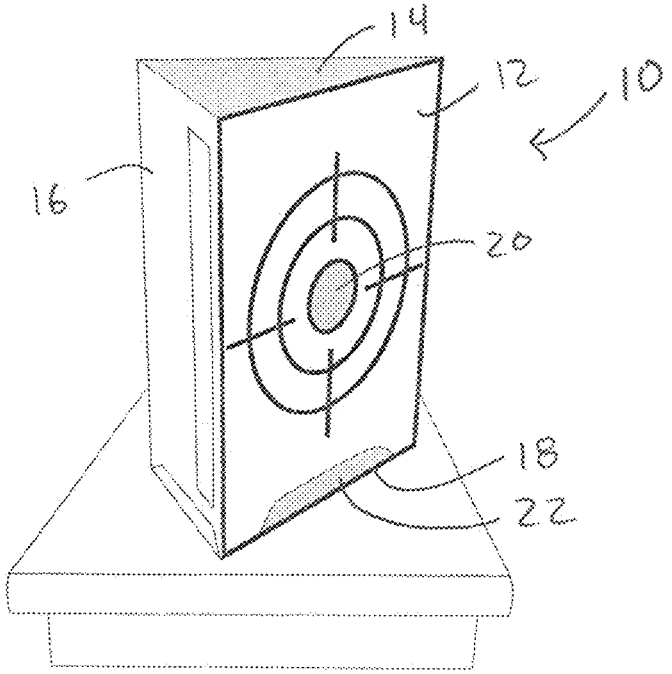
FIG. 1 is an isometric view of a target in accordance with the present invention, showing the target placed on a surface.

A target 10 is configured for mounting in the corner of a room, which representatively maybe formed by a pair of intersecting walls W1, W2. Generally, the target 10 is made up of a front wall 12, a pair of side walls 14, 16 and a bottom wall 18. The target 10 is shown as having an open top, although it is understood that the top of the target 10 may be closed by a top wall. Front wall 12 of target 10 is formed with a target opening 20 and a return opening 22. In the illustrated embodiment, the target opening 20 is illustrated as being circular and the return opening 22 is shown as having a generally horizontal, elongated configuration. It is understood, however, that target opening 20 and return opening 22 may have any other satisfactory shape as desired. Return opening 22 is formed at the bottom edge of front wall 12, extending upwardly from the intersection of bottom wall 18 with front wall 12.

Target 10 is well-suited for use with smaller and relatively lightweight flying toys or amusement devices. Representatively, target 10 may be used with flying toys such as are sold under the trademark RIFIT, as shown and described in Schneider U.S. Pat. No. 7,654,880 issued Feb. 2, 2010. The corner-mounted construction of target 10 is especially well-suited for flying toys or amusement devices that are used repeatedly or in high numbers since objects that are propelled toward and miss the target 10 altogether bounce off the walls W1 and W2 and tend to return toward the user.

When an object is propelled toward the target 10 and successfully passes through the target opening 20, the object bounces off the sidewalk 14, 16 and then falls onto and is supported by the bottom wall 18. At an appropriate time, the user then gains access to the objects through the return opening 22, which allows the user to collect the objects supported by the bottom wall 18 for subsequent use. When the objects propelled toward the target 10 are flat, the objects collected within the interior of the target 10 rest on and are supported by the bottom wall 18. In the event the objects are not flat and may have a tendency to roll in the event the objects are round or spherical, the bottom wall 18 or the front wall 12 may be formed to provide a lip at the lower extent of return opening 22, which will maintain the objects within the interior of the target 10 until they are collected by the user.

The front wall 12 and side walls 14, 16 of target 10 cooperate to form an isosceles triangle when viewed in plan. With this construction, the side walls 14, 16 are perpendicular to each other, and the front wall 12 spans between and interconnects the outer edges of side walls 14, 16. The side walls 14, 16 are adapted to be placed against walls W1, W2, respectively, with the intersection of side walls 14, 16 being positioned within the corner formed by walls W1, W2. The target 10 is maintained in position on the walls W1, W2 in any satisfactory manner. Representatively, the target 10 is non permanently affixed to the walls W1, W2 using a removable adhesive, single or double-sided tape, etc.

Figure 2:
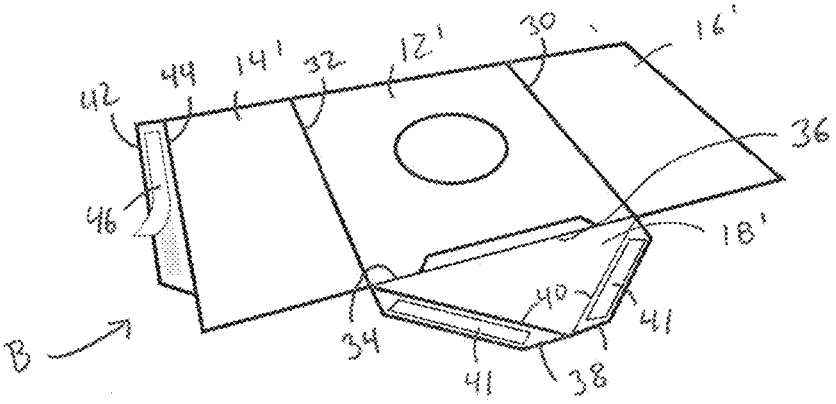
FIG. 2 is an isometric view of a target of FIG. 1 showing the target in a flattened orientation.

Target 10 may be formed by gluing or otherwise adhering the edges of walls 12, 14, 16 and 18 together. Alternatively, target 10 may be formed from a blank in which the target walls are connected together and can then be folded and secured to one another as illustrated in FIGS. 2-5. To facilitate clarity, such a construction is illustrated using primed reference characters. As shown, the erected target 10' is formed of front wall 12', side walls 14' and 16' and bottom wall 18'. The front wall 12' includes target opening 20' and return opening 22'. Turning now to FIG. 2, the target 10' is constructed from a blank B in which front wall 12' and side wall 16' are contiguous with a fold or perforation 30 therebetween, and likewise side wall 16' and front wall 12' are contiguous with a fold or perforation 32 therebetween. Bottom wall 18' is contiguous with the bottom edge of front wall 12' with a fold or perforation 34 therebetween. Bottom wall 18' has a front edge 36 that defines the lower extent of return opening 22' and that is aligned with perforation of 34. A pair of support flaps 38 extend from the side edges of bottom wall 18'. Each support flap 38 is separated from bottom wall 18 via a fold or perforation 40. Adhesive, glue or tape 41, located on each flap 38 may be provided to secure the flaps 38 to side walls 14' and 16', in the erected orientation illustrated in FIG. 5. Alternatively, a slot may be formed along each perforation 40 for engaging tabs along the side walls 14', 16'.

A side flap 42 extends from the edge of side wall 14' opposite perforation 32, and is separated from a side wall 14' by a fold or perforation 44. Adhesive, glue or tape 46 may be located on the side flap 42 to secure the side flaps 42 to side walls 16', in the erected orientation illustrated in FIG. 4. Alternatively, one or more slots may be formed along perforation 44 for engaging tabs along the side wall 16'.

In one embodiment, not shown, rather than securing the target 10 in an erected orientation via adhesive or tape, a bottom locking tab extends from sidewall 16', and is movable relative to sidewall 16' via a pair of slits and a fold or perforation. Similarly, a bottom locking tab and extends from sidewall 14' and is movable relative to sidewall 14' via a pair of slits and a folder perforation. A pair of side locking tabs may extend from the free edge of sidewall 14'. A fold or perforation is formed between each side locking tab and sidewall 14'. A slit is formed between the edge of sidewall 14' and each end of each locking tab. Blank B may be subsequently flattened in the folded orientation for shipping or storage. To accomplish this the bottom wall 18' is folded upwardly about fold line 34, sidewall 14' is folded about fold line 32 on to sidewall 16', and the folded sidewalls 14', 16' are then folded about fold line 30 onto the folded bottom wall 18' and front wall 12'.

Figure 3:
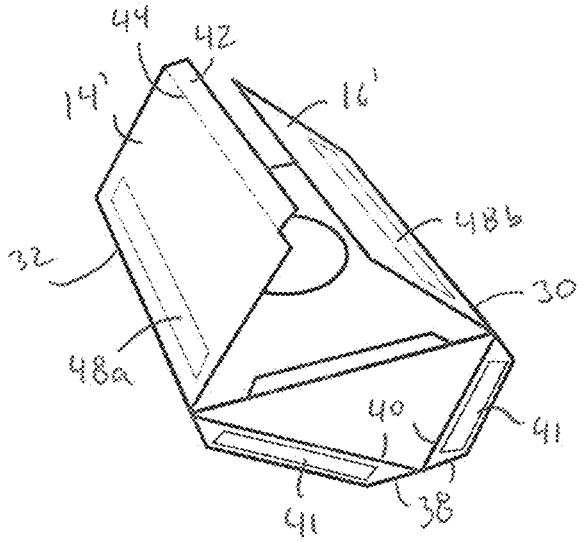
FIG. 3. is a isometric view of a target of FIG. 1 showing the target in a partially folded orientation.
Figure 4:
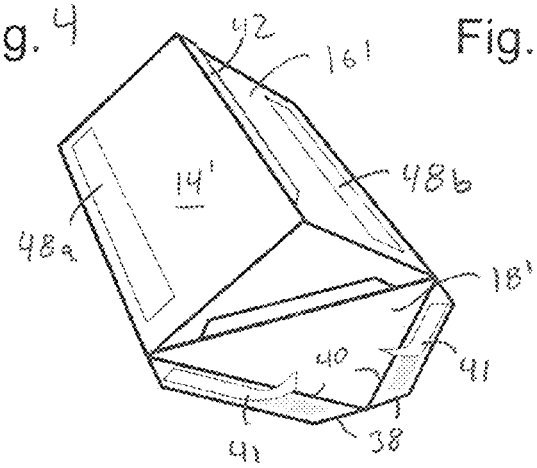
FIG. 4. is a isometric view of a target of FIG. 1 showing the target in another partially folded orientation.
Figure 5:
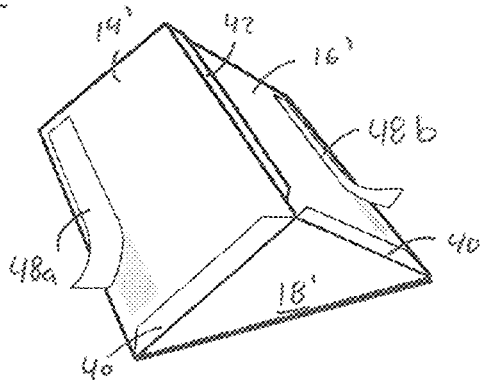
FIG. 5. is a isometric view of a target of FIG. 1 showing the target resting on its front wall in a folded orientation.
Figure 6:
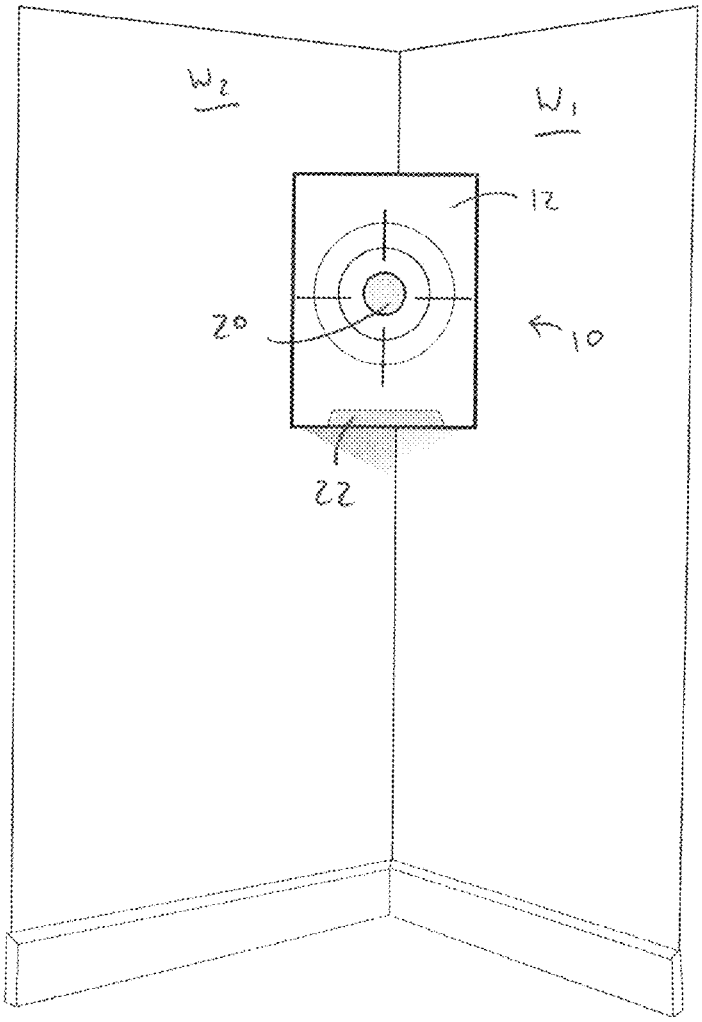
FIG. 6 is a front elevation view of a target of FIG. 1 mounted in a corner of a room.
Figure 7:
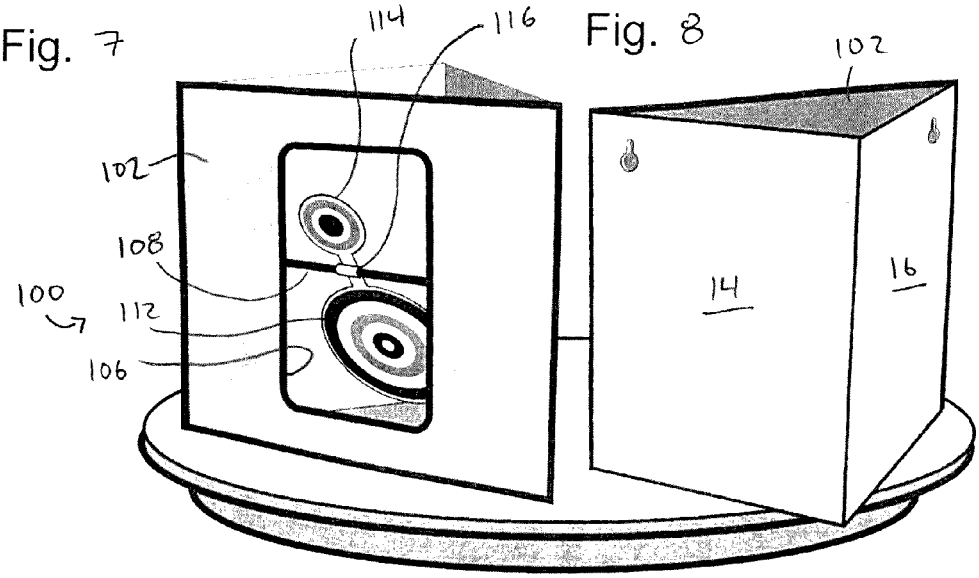
FIG. 7 is a front isometric view of an alternative target in accordance with the present invention.
Figure 8:
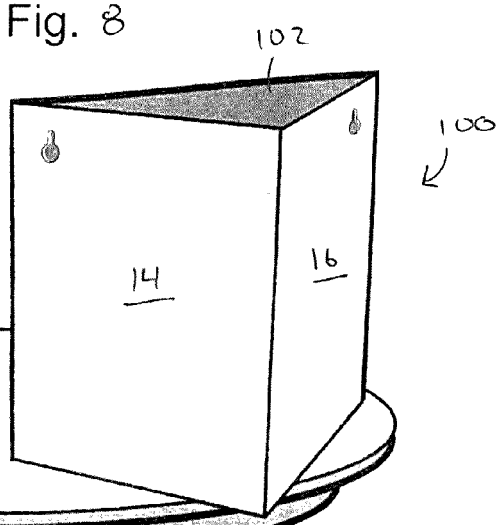
FIG. 8 is a rear isometric view of the target of FIG. 7.

Still referring to FIGS. 2-5, and specifically FIG. 3, Blank B is directed to form target 10 by first folding bottom wall 18' about fold line 34, and folding support flaps 38 upwardly. Sidewall 14' is then folded about fold line 32 and sidewall 16' is folded about fold line 30, so that the lower extent of each sidewall 14' and 16' is moved against the upwardly folded bottom wall support flaps 38. Turning now to FIG. 4, support flap 42 is folded about fold line 44 and the outer extent of sidewall 14' is then positioned against the folded support flap 42. The adhesive 46 may be exposed and adhered to the outer extent of sidewall 14'. Turning now to FIG. 5, adhesive 41 on the two support flaps 38 is exposed and adhered to the outer extend of sidewalls 14' and 16' as the bottom panel 18' is folded about perforated line 34, so that the walls 12', 14', 16' and 18' are locked together to fully erect target 10'. Target 10' is then positioned into a corner and secured against the walls W1, W2 by way of adhesive areas 48*a* and 48*b*, and is ready for use.

It is understood that the specific configuration of walls, fold lines, adhesive areas, tabs and/or slots of blank 13 as shown are simply representative of any number of satisfactory blank configurations that may be employed.

Figure 9:
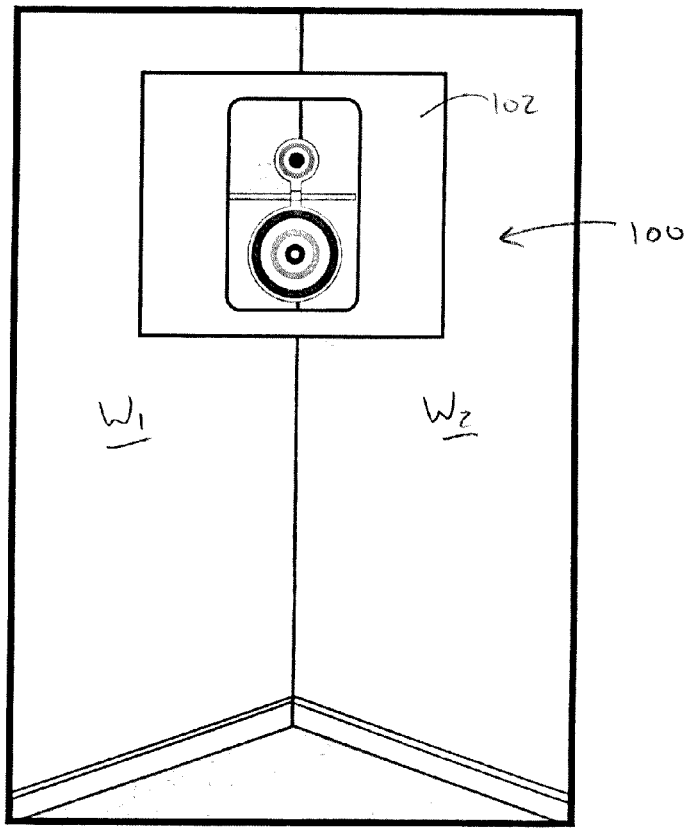
FIG. 9 is a front elevation view of a target of FIG. 7 mounted in a corner of a room.
Figure 10:
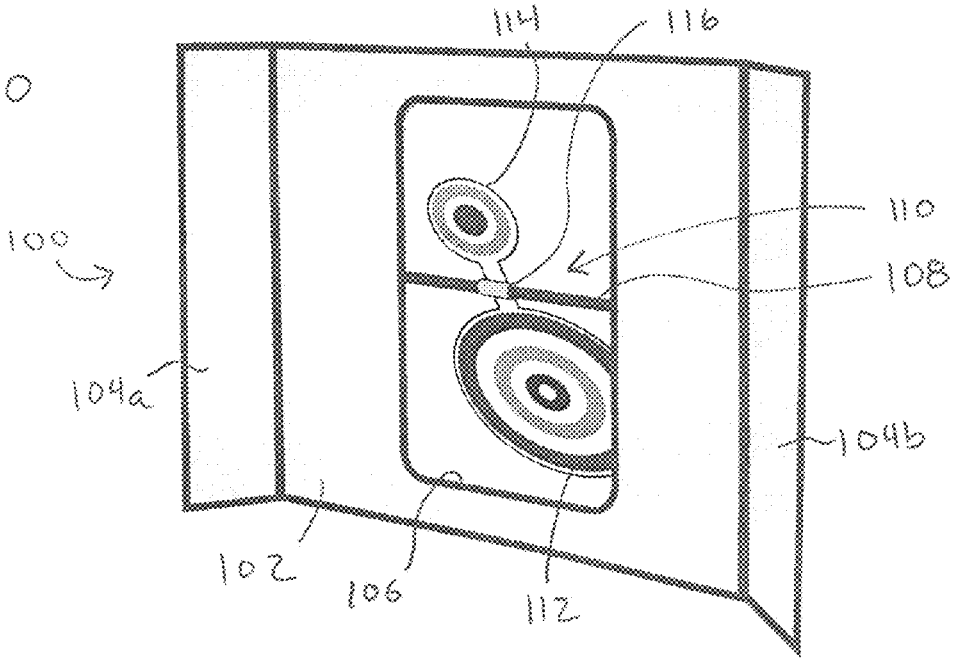
FIG. 10 is a front isometric view of an alternative embodiment of the target of FIG. 7.

Turning no to FIGS. 7-16, in another embodiment, a spinner-type target 100 includes a main wall 102 and a pair of side walls 14, 16, as were described above in the description of target 10. Alternatively, rather than the side walls shown in FIGS. 7 and 8, the spinner-type target 100 may include mounting tabs or areas 104*a*, 104*b*, as illustrated in FIG. 9 and will be described in further detail below. In this embodiment, main wall 102 is formed with an opening 106, and a target portion support 108 extends across opening 106. In the illustrated embodiment, support 108 is in the form of a generally horizontal support rod that extends between a pair of generally vertical edges that partially define opening 106, although it is understood that any other configuration may be employed.

A target portion 110 is supported for rotation on target portion support 108. The target portion 110 includes a primary target area 112 and a secondary target area 114, which are separated by and interconnected with a bridge or mounting area 116. The bridge 116 has a passage or other suitable structure within which target portion support 108 is received, so that target portion 110 is rotatable on support 108. In the illustrated embodiment, secondary target area 114 is located below primary target area 112, and may be weighted so as to bias target portion 110 to a generally vertical orientation. Alternatively, target portion support 108 may be positioned in the upper area of opening 106 and primary target area 112 located below secondary target area 114, such that the greater mass of primary target area 112 relative to secondary target area 114 functions to bias target portion 110 to a generally vertical orientation. In a configuration such as this, the upper secondary target portion 114 may be eliminated so that a single primary target area is suspended from the target support 108. In these embodiments, target portion 110 is thus able to pivot or swing on target portion support 108 relative to main wall 102 when struck by a flying projectile.

Figure 11:
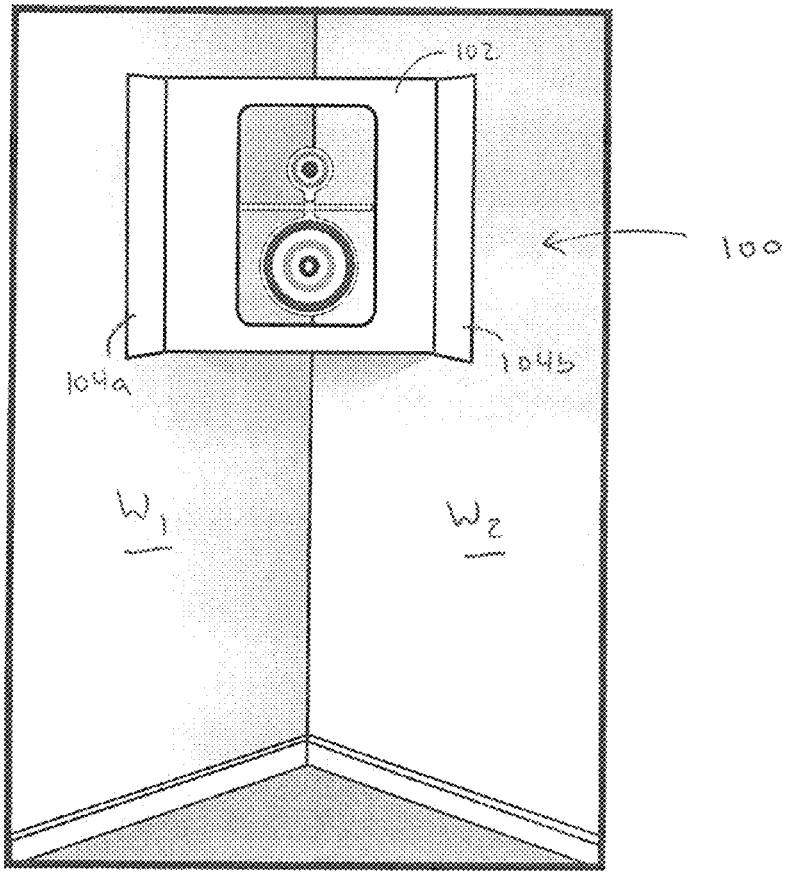
FIG. 11 is a front elevation view of a target of FIG. 10 mounted in a corner of a room.
Figure 12:
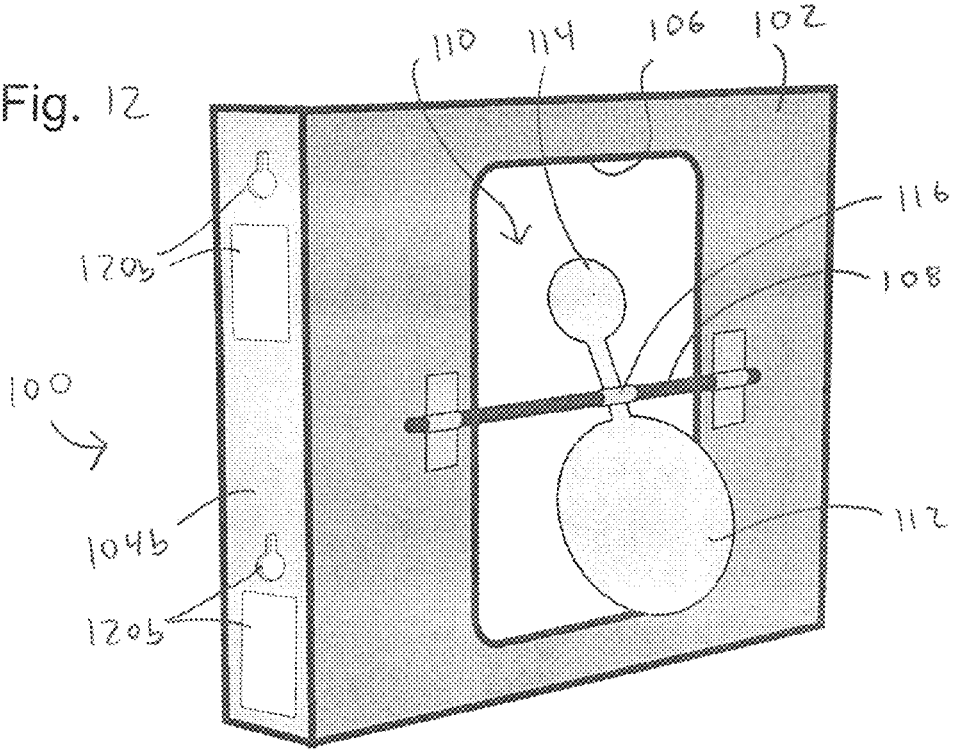
FIG. 12 is a rear isometric view of a target of FIG. 10.
Figure 13:
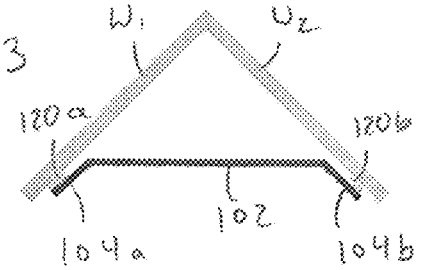
FIG. 13 is a top plan view of a target of FIG. 10 mounted in a corner of a room.
Figure 14:
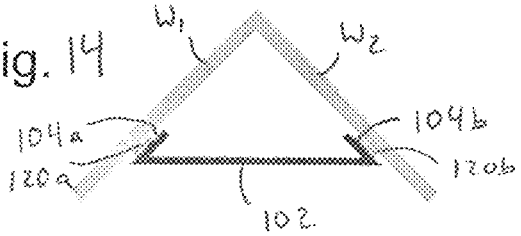
FIG. 14 is a top plan view of an alternative embodiment of a target of FIG. 10 mounted in a corner of a room.
Figure 15:
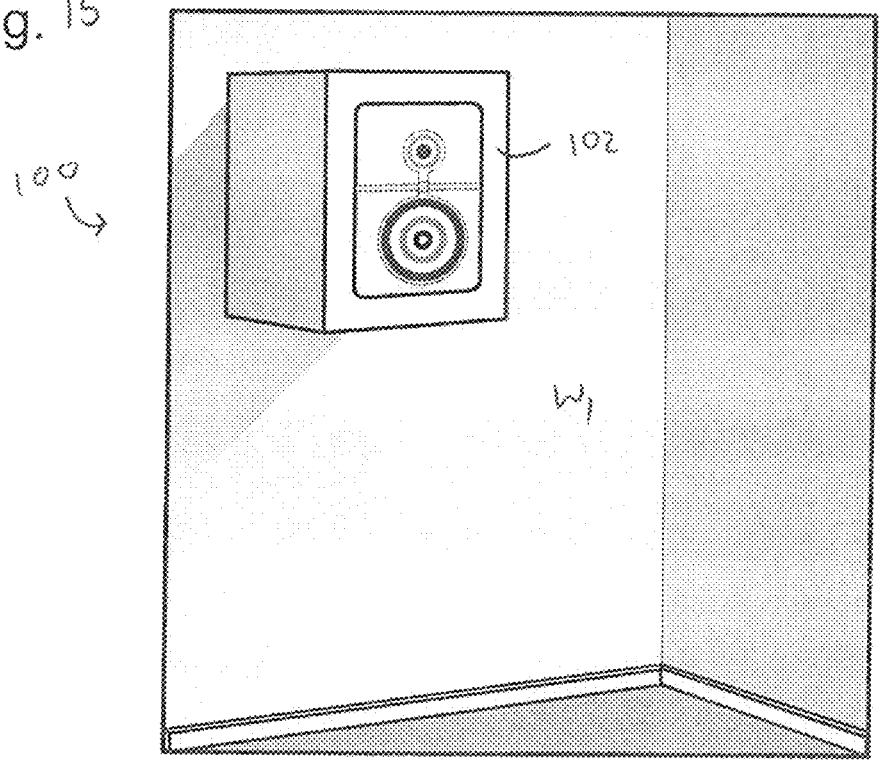
FIG. 15 is an isometric view of an alternative embodiment of the target of FIG. 10 mounted on a wall of a room.
Figure 16:
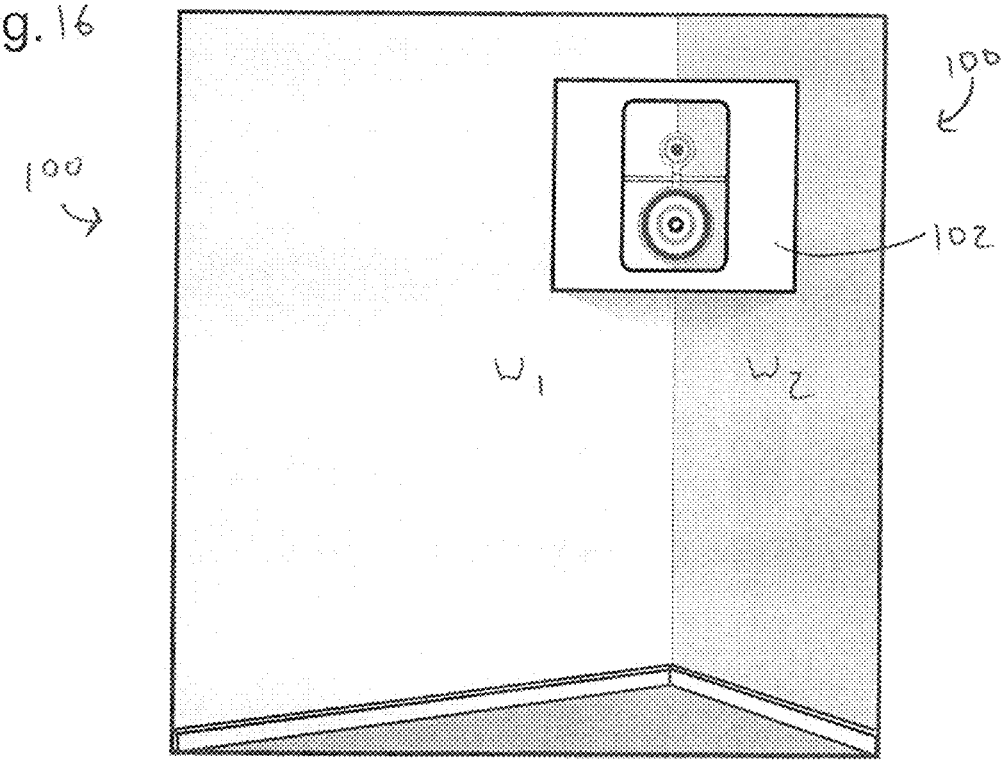
FIG. 16 is a front elevation view of a target of FIG. 10 mounted in a corner of a room

As illustrated in FIGS. 12-14, the mounting tabs or areas 104*a*, 104*b* may include a plurality of adhesive areas 120*a*, 120*b* configured to mount the target 10, on the front side or rear side of the mounting tabs 104*a*, 104*b*. As seen in FIGS. 11 and 13, with the adhesive areas located on the rear side of the mounting tabs 102*a*, 104*b*, the mounting tabs 102*a*, 104*b* are visible when the target is mounted to walls W1 and W2. Alternatively, as seen in FIGS. 9 and 12, with the adhesive areas 120*a*, 120*h* located on the front side of the mounting tabs 102*a*, 104*b*, the mounting tabs 102*a*, 104*b* are not visible when the target is mounted to walls W1 and W2. In yet another alternative, illustrated in FIG. 12, the mounting tabs or areas 104*a*, 104*b* may include alternative securement methods at the adhesive areas 120*a*, 120*b* such as glue dots, hook and loop fasteners, mechanical fasteners such as thumbtacks, etc.

Figure 17:
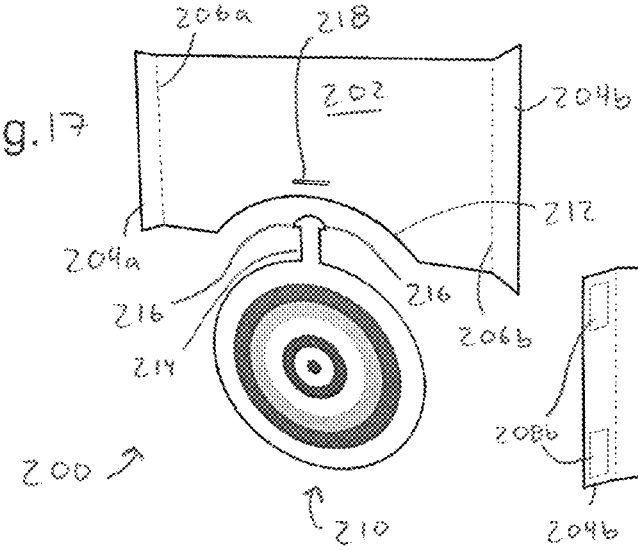
FIG. 17 is a front isometric view of an alternative target in accordance with the present invention showing the target in a disassembled orientation.
Figure 18:
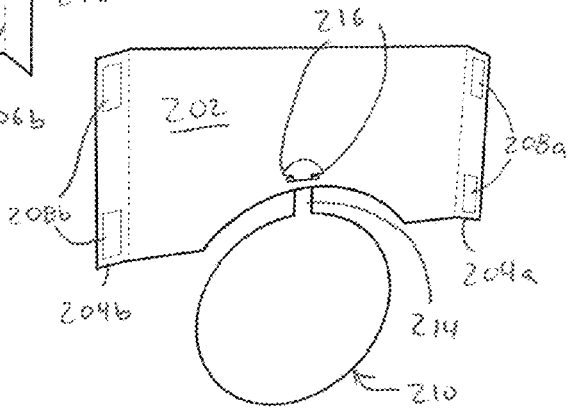
FIG. 18 is a rear isometric view of a target of FIG. 17 showing the target in an assembled orientation.
Figure 19:
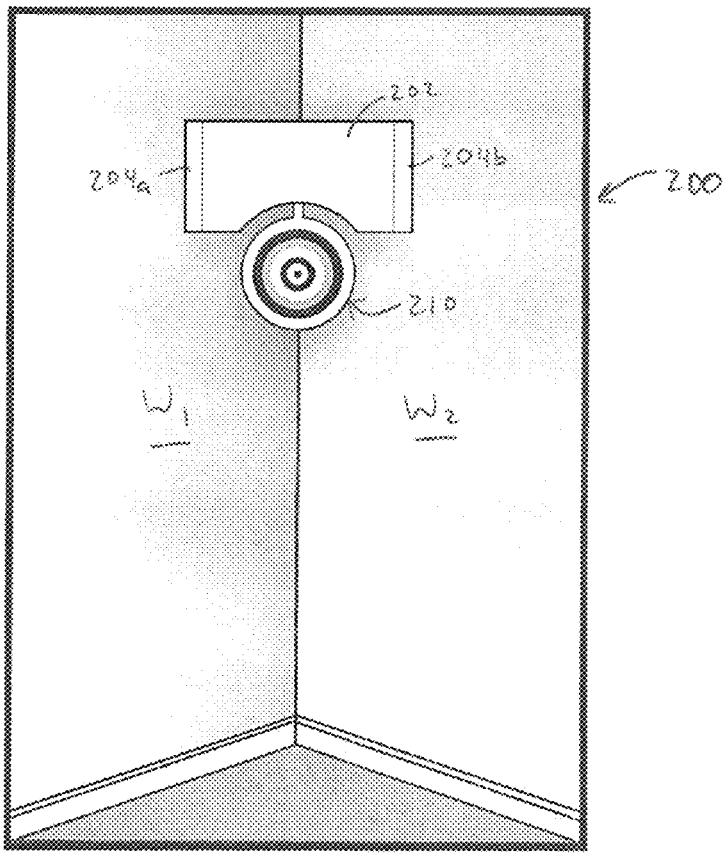
FIG. 19 is a front elevation view of a target of FIG. 17 mounted in a corner of a room.
Figure 26:
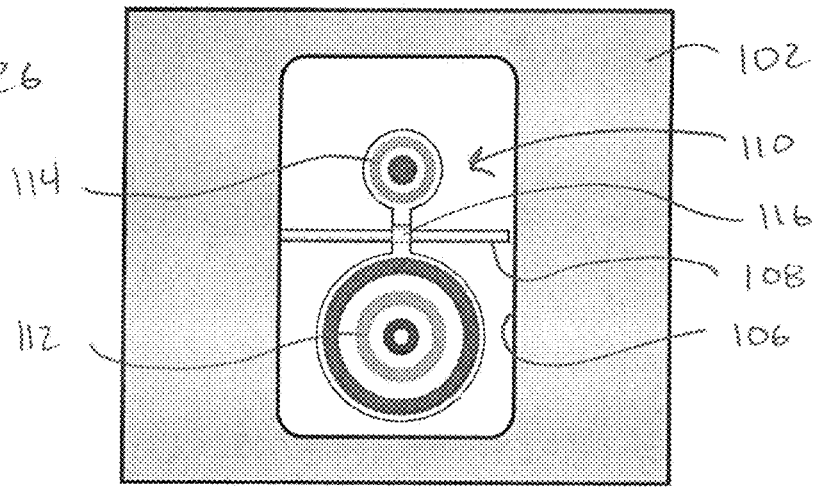
FIG. 26 is a front elevation view of a front wall of a target of FIG. 7.
Figure 27:
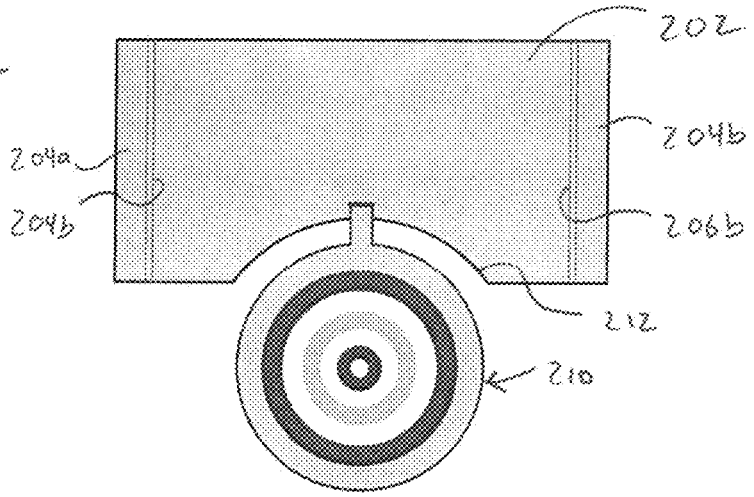
FIG. 27 is a front elevation view of a front wall of a target of FIG. 17.
Figure 28:
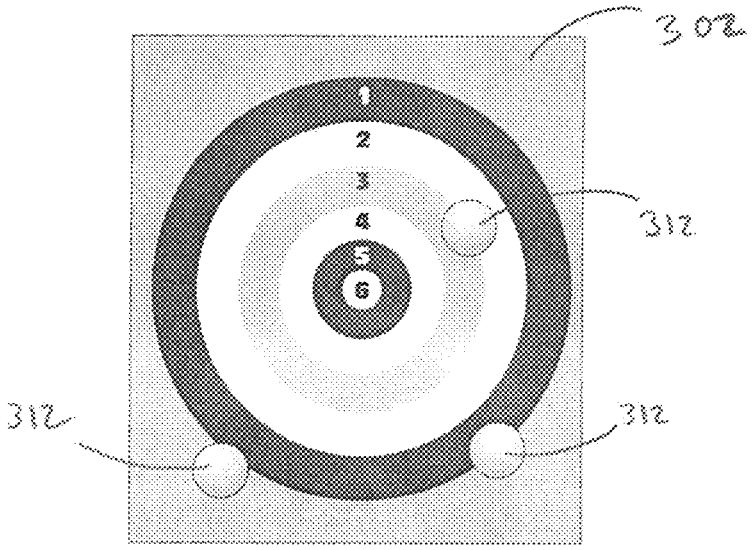
FIG. 28 is a front elevation view of a front wall of a target of FIG. 20.

Turing now to FIGS. 17-19, in another embodiment, a gong target 200 may be engaged with and extend between walls W1 and W2, in a manner somewhat similar to that of targets 10, 100. In this version, as described above with regards to target 100, the connected sidewalls 14, 16 of the target are eliminated, such that target 200 generally consists of a main body or wall 202 having mounting areas or flaps 204*a*, 204*b* at its ends. Score lines, such as 206*a*, 206*b* separate main wall 202 from mounting areas 204*a*, 204*b*. In this manner, main wall 202 and mounting areas 204*a*, 204*b* can be formed of a single sheet of material if desired.

Mounting areas 204*a*, 204*b* are provided with means for engagement with or securement to the walls W1, W2. Representatively, such engagement means may be in the form of adhesive areas such as 208*a*, 208*b* on the back sides of respective mounting area 204*a*, 204*h*. Other temporary or permanent engagement or securement methods may be employed as desired, such as glue dots, hook and loop fasteners, mechanical fasteners such as thumbtacks, etc. Mounting areas 204*a*, 204*b* may be folded about score lines 206*a*, 206*b*, respectively, either inwardly or outwardly as desired, and the engagement means accordingly is located on either the front or rear surfaces, respectively, or mounting areas 204*a*, 204*b*.

In addition to main wall 202, target 200 further includes a target portion 210 engaged with and suspended from main wall 202, in a gong-type manner. The target portion 210 may have any satisfactory configuration or shape as desired, and in the illustrated embodiment is generally circular. Representatively, although not necessarily, the main wall 202 may include an indentation 212 in its lower edge that matches the configuration of a portion 210. In the illustrated embodiment, the indentation 212 is arcuate and has a radius similar to that of target portion 210, although any other configuration and relationship may be employed. In this version, the target portion 210 includes a hanger extension 214 having tabs 216 at its upper end. The main wall 202 is formed with a slot 218, which has a length slightly less than the width of hanger extension 214 as defined by tabs 216. In this manner, tabs 216 can be inserted through slot 218, and then engage main wall 202 adjacent the ends of slot 218 to maintain target portion 210 in engagement with main wall 202 in a suspension-type manner. Target portion 210 is thus able to pivot or swing relative to main wall 202 when struck by a flying projectile.

Turning now to FIGS. 20-25, and initially FIGS. 20-22, in another embodiment, the present invention also contemplates that the target may be constructed to either be mounted in a wall corner as described above, or may be supported on a horizontal surface such as a table or desk top, with a horizontal surface S. An option such of this embodiment is shown as target 300, which includes a main front target wall 302 and a pair of rearwardly extending side walls 304, 306, which cooperate to define a generally triangular configuration when folded and interconnected together. Alternatively, as illustrated in FIGS. 20 and 21, the side walls 304, 306 may meet a rear wall 308, thereby providing additional support for the target 300 when placed on a flat surface while simultaneously allowing the target 300 to be wall corner mounted. The bottom edges of the walls 302-308 are coplanar, so that the target 300 is generally upright when placed on a horizontal surface, such as shown at S. The side walls 304, 306 are also provided with wall engagement means 310, such as adhesive, hook-and-loop fasteners, keyhole openings, etc., which enable the target 300 to be mounted in a corner defined by walls W1, W2 if desired. In the illustrated version, the forwardly facing surface of front target wall 302 has hook- or loop-type fabric, and the projectiles 312

Alternatively, as illustrated in FIGS. 23-25, the target 300 may include a forward facing surface of front target wall 302 with an integrated digital surface. The digital surface may be an organic electro-luminescence display such as an ° LED, and capable of displaying both a target area 314 and a score keeping area 316. In one embodiment, the digital surface may be pressure sensitive to receive feedback from contact with projectiles 312. In this embodiment, as illustrated in FIG. 23, the target 300 includes only a front target wall 302 and a rear is 308, in which the rear wall is curved to form a coplanar edge with the front target wall 302, so that the target 300 is generally upright when placed on a horizontal surface, such as shown at S.

Figure 29:
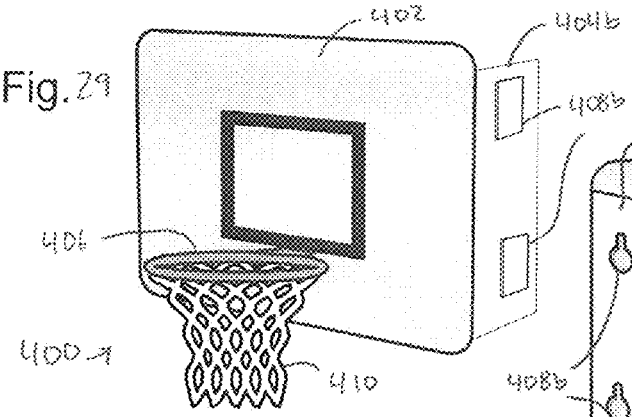
FIG. 29 is a front isometric view of an alternative target in accordance with the present invention.
Figure 30:
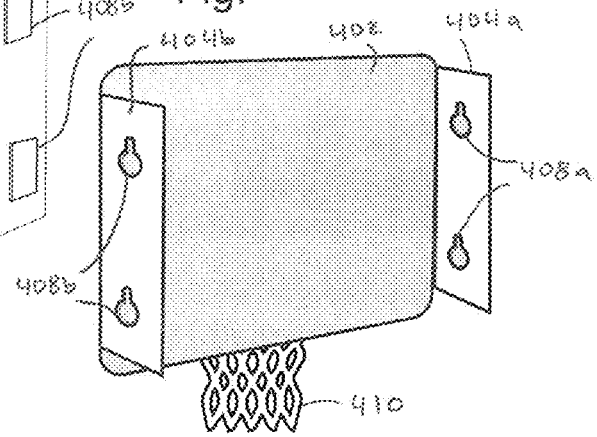
FIG. 30 is a rear isometric view of a target of FIG. 29.
Figure 31:
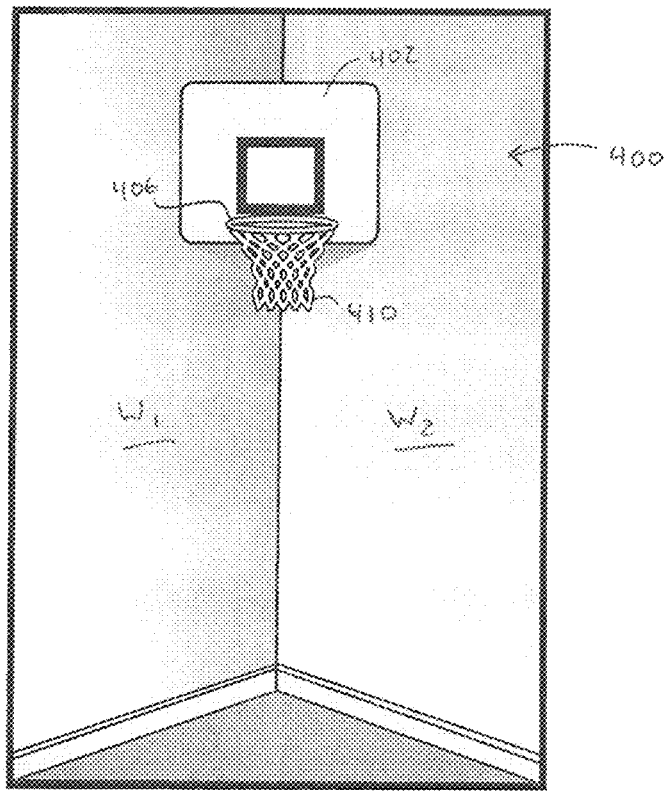
FIG. 31 is a front elevation view of a target of FIG. 29 mounted in a corner of a room.

Turning now to FIGS. 29-31, in another embodiment, a backboard-type target 400 for use with a foam basketball includes a main wall 402 and a pair of mounting tabs or areas 404*a*, 404*b*, similar to targets 100, 200, 300 described above. In this version, main wall 402 may be formed of a relatively rigid material that is sufficient to support a basketball rim 406 and net 410. The mounting areas 404*a*, 404*b* again are provided with satisfactory wall engagement means 408*a*, 408*b*, such as adhesive areas, hook-and-loop fastener strips, keyhole slots for receiving wall-mounted screw heads, etc.

Figure 32:
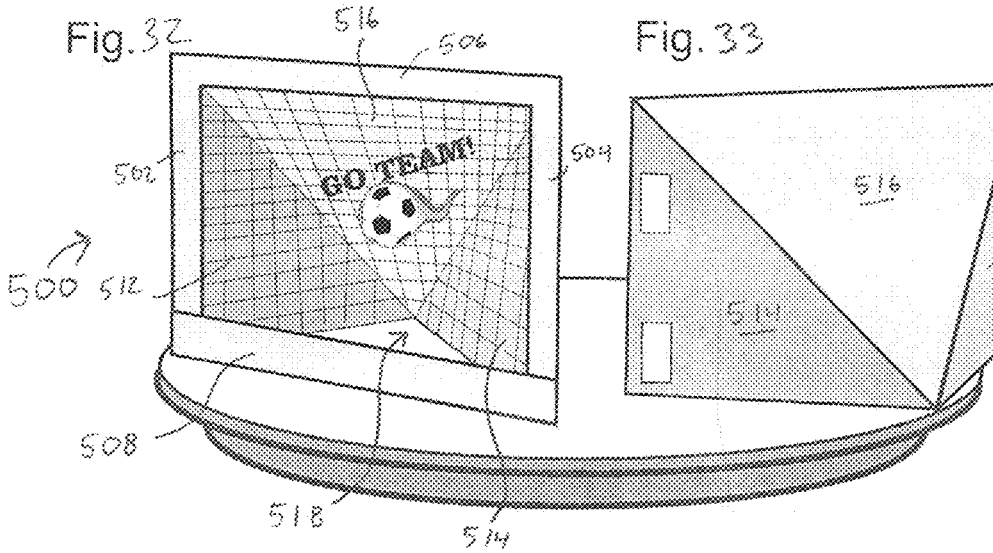
FIG. 32 is a front isometric view of an alternative target in accordance with the present invention.
Figure 33:
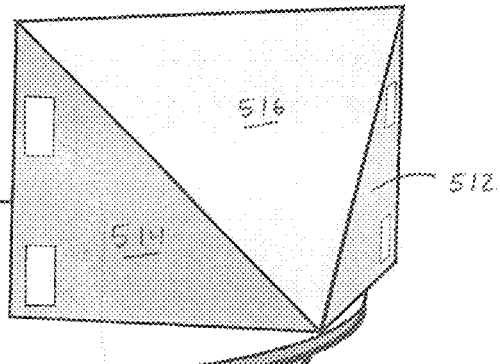
FIG. 33 is a rear isometric view of a target of FIG. 32.
Figure 34:
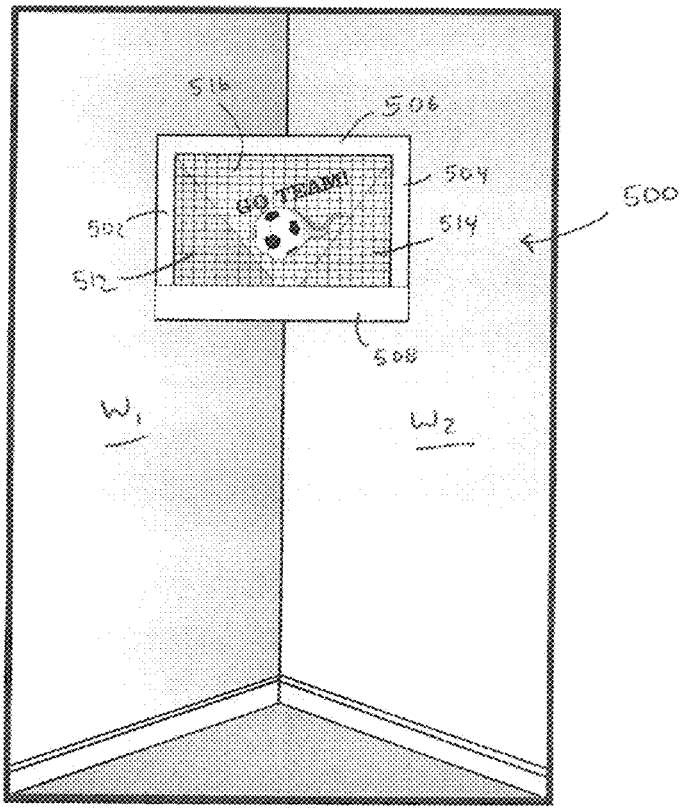
FIG. 34 is a front elevation view of a target of FIG. 32 mounted in a corner of a room.

In yet another embodiment, illustrated in FIGS. 32-34, a goal-type target 500 for use with a foam soccer ball, hacky sack, foot bag or the like is adapted for mounting to walls W1, W2. Goal-type target 500 includes a main forwardly facing frame portion defined by vertical sections 502, 504 and horizontal sections 506, 508, which together define a goal opening 510. A pair of angled side walls 512, 514 extend rearwardly from vertical frame sections 502, 504, respectively. A top wall 516 extends rearwardly and downwardly from upper horizontal frame section 506, and extends between and interconnects side walls 512, 514. The lower edges of walls 512 and 514 cooperate with lower horizontal frame section 508 do define a downwardly facing opening 518, through which the ball or other projectile may pass when it travels through the opening 510 defined by frame sections 502-508. In this embodiment, the wall engagement means such as adhesive, fasteners or the like is provided on the rearwardly facing surfaces of side walls 512, 514.

Figure 35:
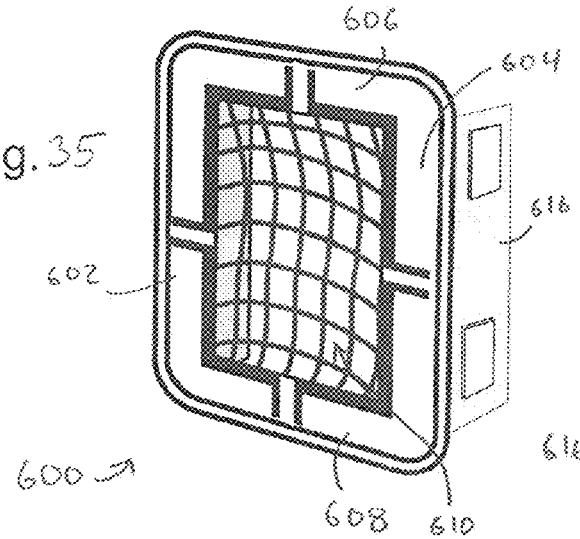
FIG. 35 is a front isometric view of an alternative target in accordance with the present invention.
Figure 36:
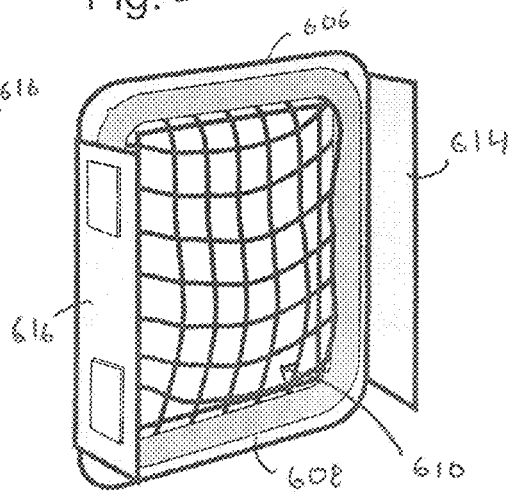
FIG. 36 is a rear isometric view of a target of FIG. 35.
Figure 37:
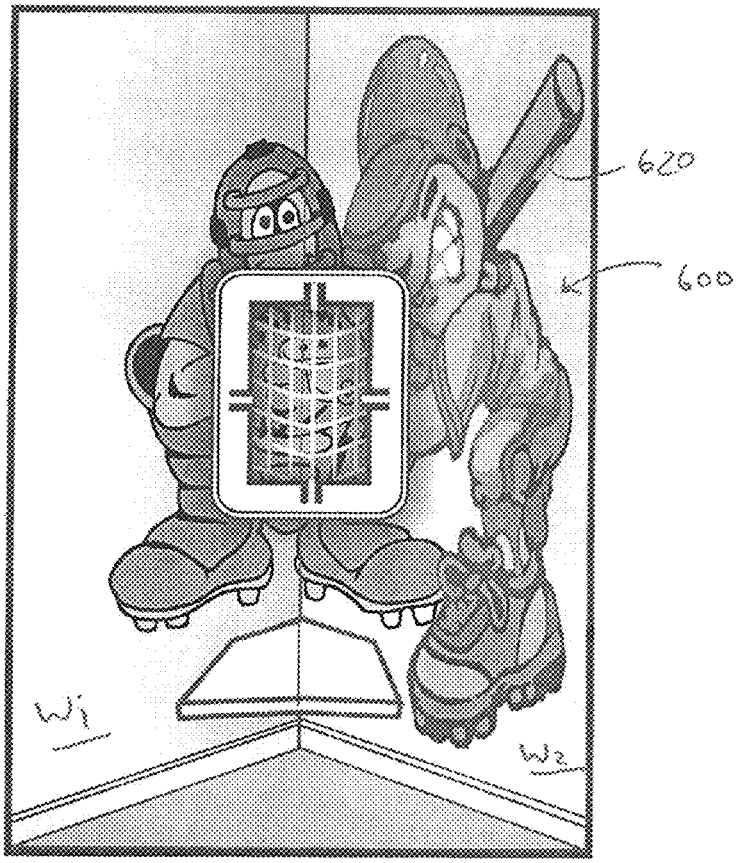
FIG. 37 is a front elevation view of a target of FIG. 35 mounted in a corner of a room.
Figure 42:
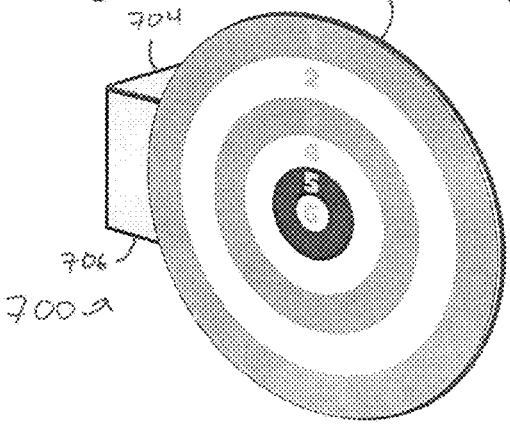
FIG. 42 is a front isometric view of an alternative embodiment of a target in accordance with the present invention.
Figure 43:
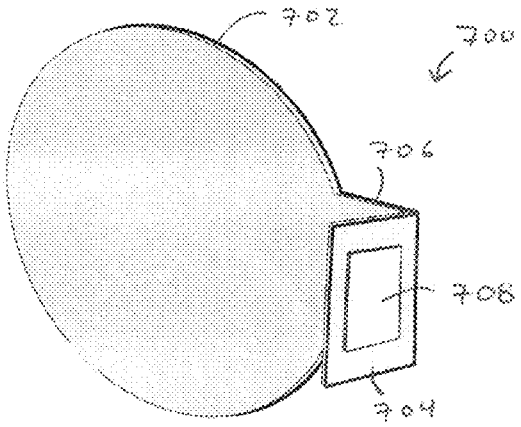
FIG. 43 is a rear isometric view of a target of FIG. 42.
Figure 44:
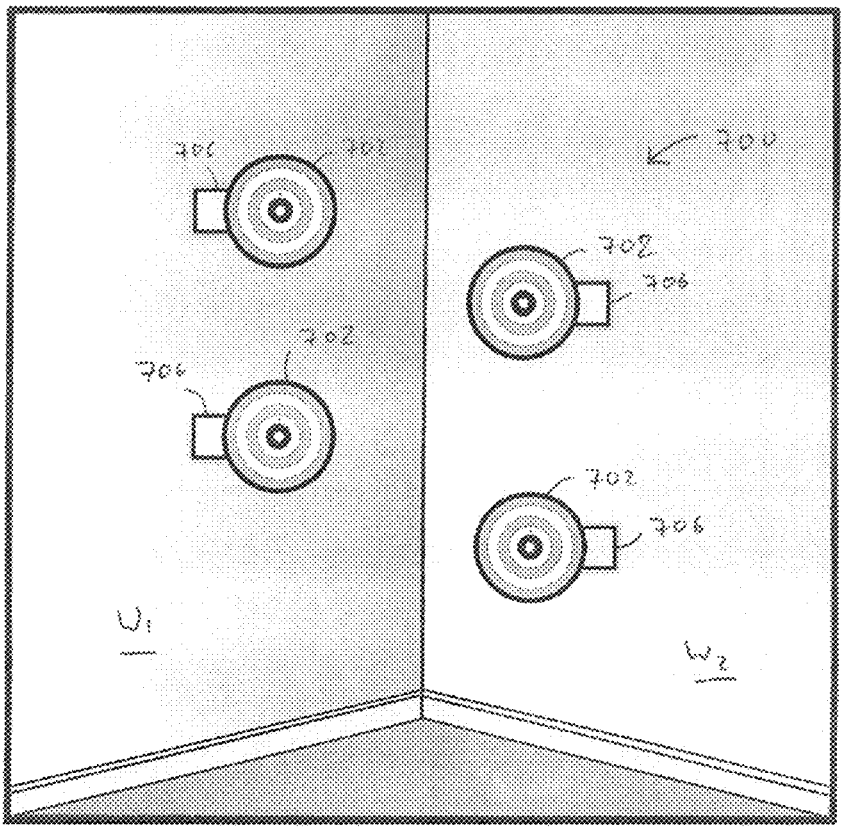
FIG. 44 is a front elevation view of multiple targets of FIG. 42 mounted near a corner of a room.
Figure 45:
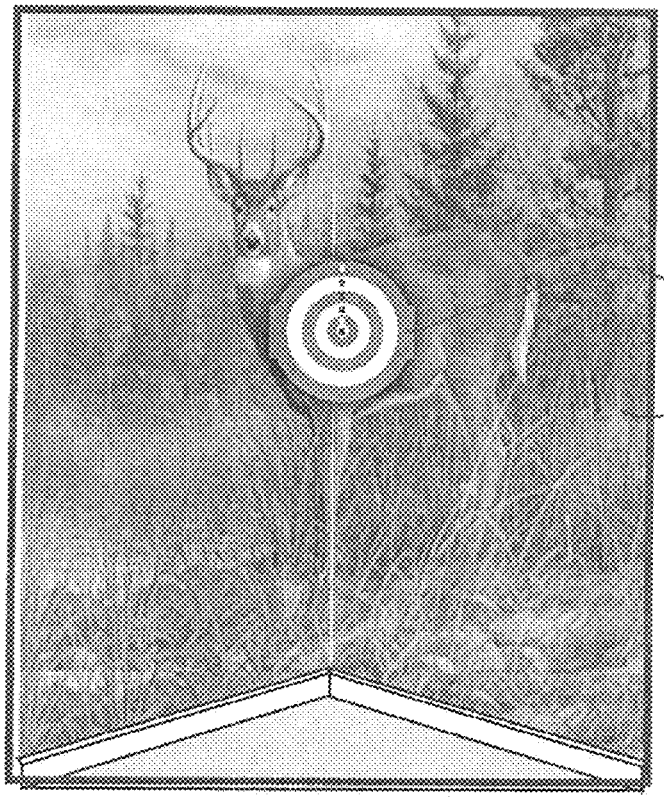
FIG. 45 a front elevation view of an alternative embodiment of a target of FIG. 42 mounted in a corner of a room.
Figure 46:
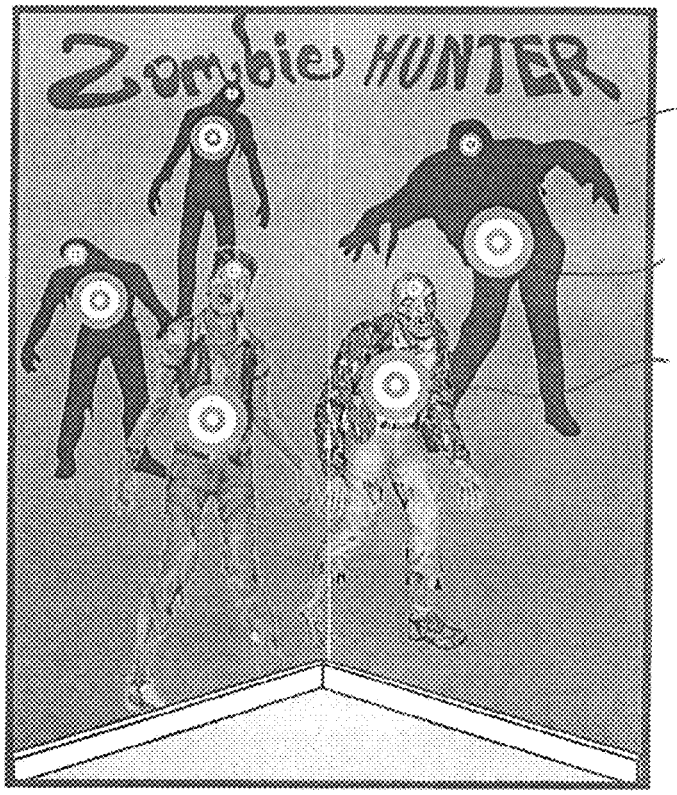
FIG. 46 a front elevation view of an alternative embodiment of multiple targets of FIG. 42 mounted in a near of a room.
Figure 47:
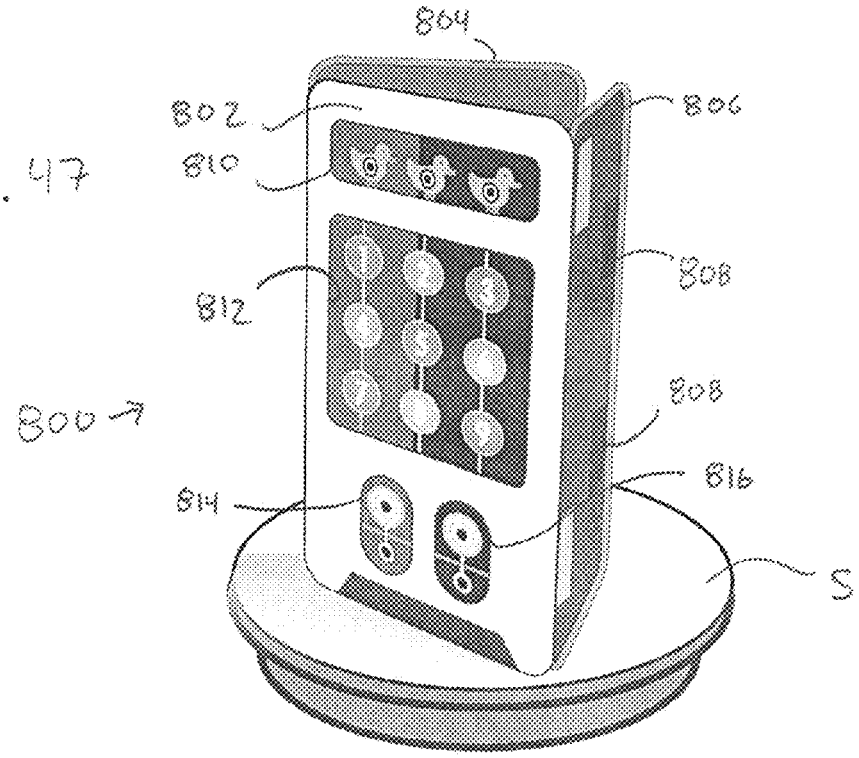
FIG. 47 is a front isometric view of an alternative embodiment of a target in accordance with the present invention.
Figure 48:
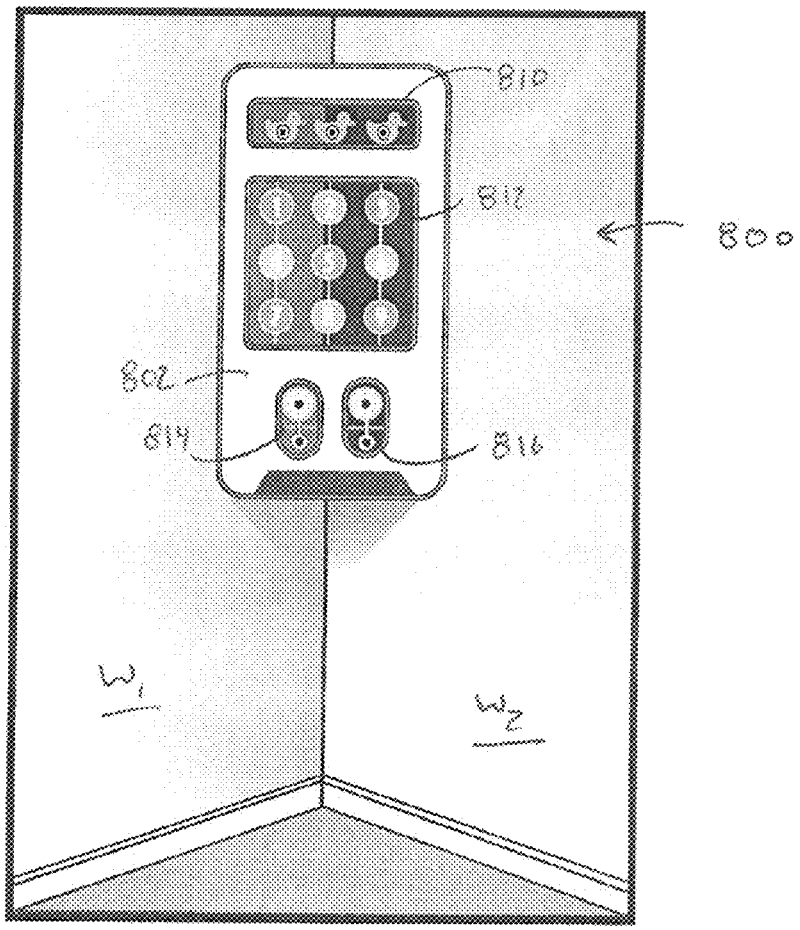
FIG. 48 is an alternative front elevation view of a target of FIG. 47 mounted in a corner of a room.
Figure 49:
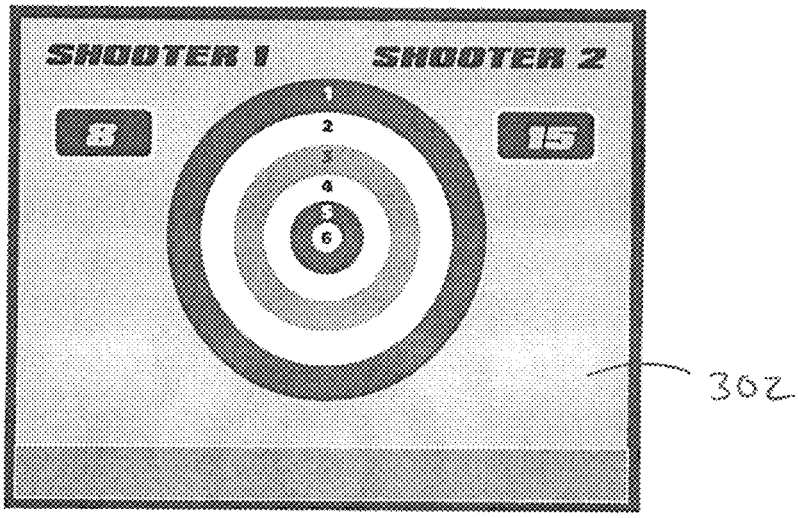
FIG. 49 is a front elevation view of a front wall of a target of FIG. 23.
Figure 50:
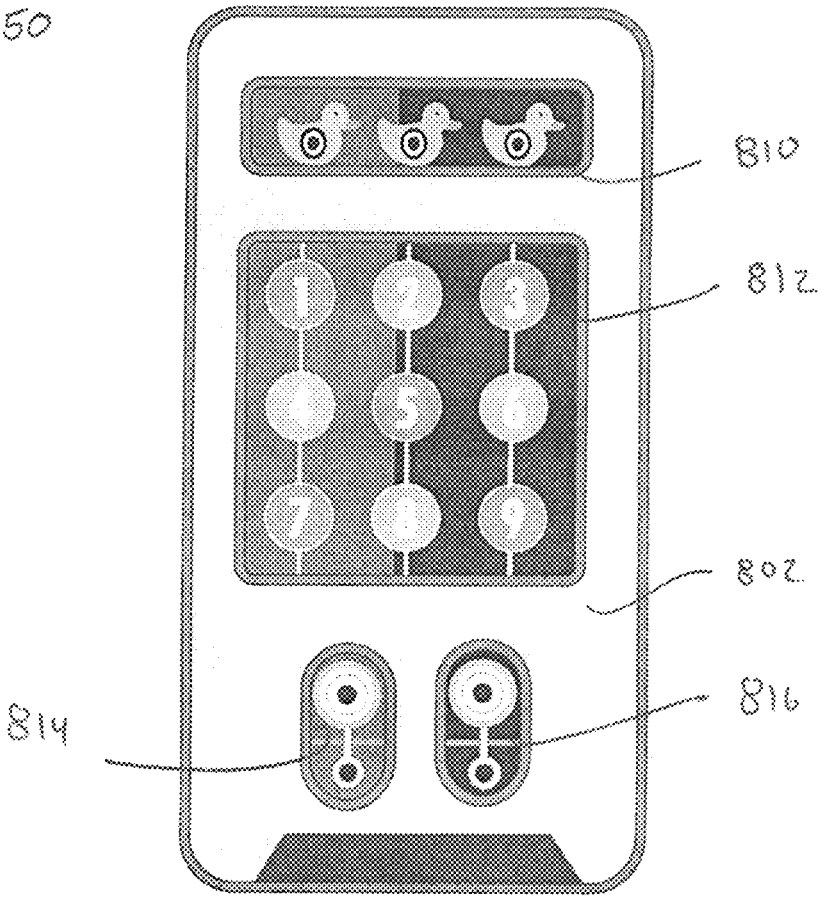
FIG. 50 is a front elevation view of a front wall of a target of FIG. 47.

In a further embodiment, as seen in FIGS. 35-37, a net-type target 600 for use with a baseball or the like is adapted for mounting to walls W1, W2. Net-type target 600 includes a main forwardly facing frame portion defined by vertical sections 602, 604 and horizontal sections 606, 608, which together define a net opening 610. A net 612 is secured to frame sections 602-608 within opening 610. Mounting tabs or areas 614, 616 extend rearwardly from vertical frame sections 602, 604, respectively, and are provided with wall engagement means such as adhesive, hook-and-loop fasteners, etc., as described previously.

If desired, any of the corner-mounted targets disclosed herein may be used in combination with one or more wall graphics 620 to provide a backdrop or environment for the target, as illustrated in FIGS. 38-41, and 45-46. The wall graphics may be player-type graphics that relate to the type of sport to which the target relates, such as football, basketball, soccer, baseball, etc., or may simply provide a backdrop or environment for the target.

Turning now to FIGS. 42-46, the present invention also contemplates a side mounted or standoff target, shown at 700. In this embodiment, the target 700 includes a main target area 702, a mounting tab or area 704 and a stand-off 706 that extends between and interconnects main target area 702 and mounting area 704 including an adhesive area 708 or alternate wall mounting means. A score line is provided between mounting area 704 and stand-off 706, which enables areas 704 and 706 to be bent relative to each other. The target 700 is preferably made of a material that provides a degree of resilience at the score line, e.g. a so-called "living hinge," so that the stand-off 706 and main target area 702 deflect rearwardly when struck by a flying projectile and then return forwardly. If desired, side mounted or standoff target 700, disclosed above may be used in combination with one or more wall graphics 710 to provide a backdrop or environment for the target as discussed above and illustrated in FIGS. 45 and 46.

Alternatively, a target 800, which also may either be mounted to a corner defined by walls W1, W2 or supported on surface S, includes a main front target wall 802 and a pair of side walls 804, 806. In this version, the walls may have a wire frames connected by suitable hinges, with the frames being covered in a mesh-type material. It is understood, however, that any other satisfactory construction may be employed. The ends of the side walls may have suitable connection means, such as hook-and-loop latches 808, which secure the rear edges of the side walls 804, 806 together in a triangular configuration. The side walls 804, 806 are also provided with wall engagement means, such as adhesive, hook-and-loop fasteners, keyhole openings, etc., which enable the target 800 to be mounted in a corner defined by walls W1, W2 if desired. In this version, the front wall 802 has several openings, shown at 810, 812, 812, 814, 816 within which various pivoting, swivel or other types of targets may be positioned as desired.

Figure 51:
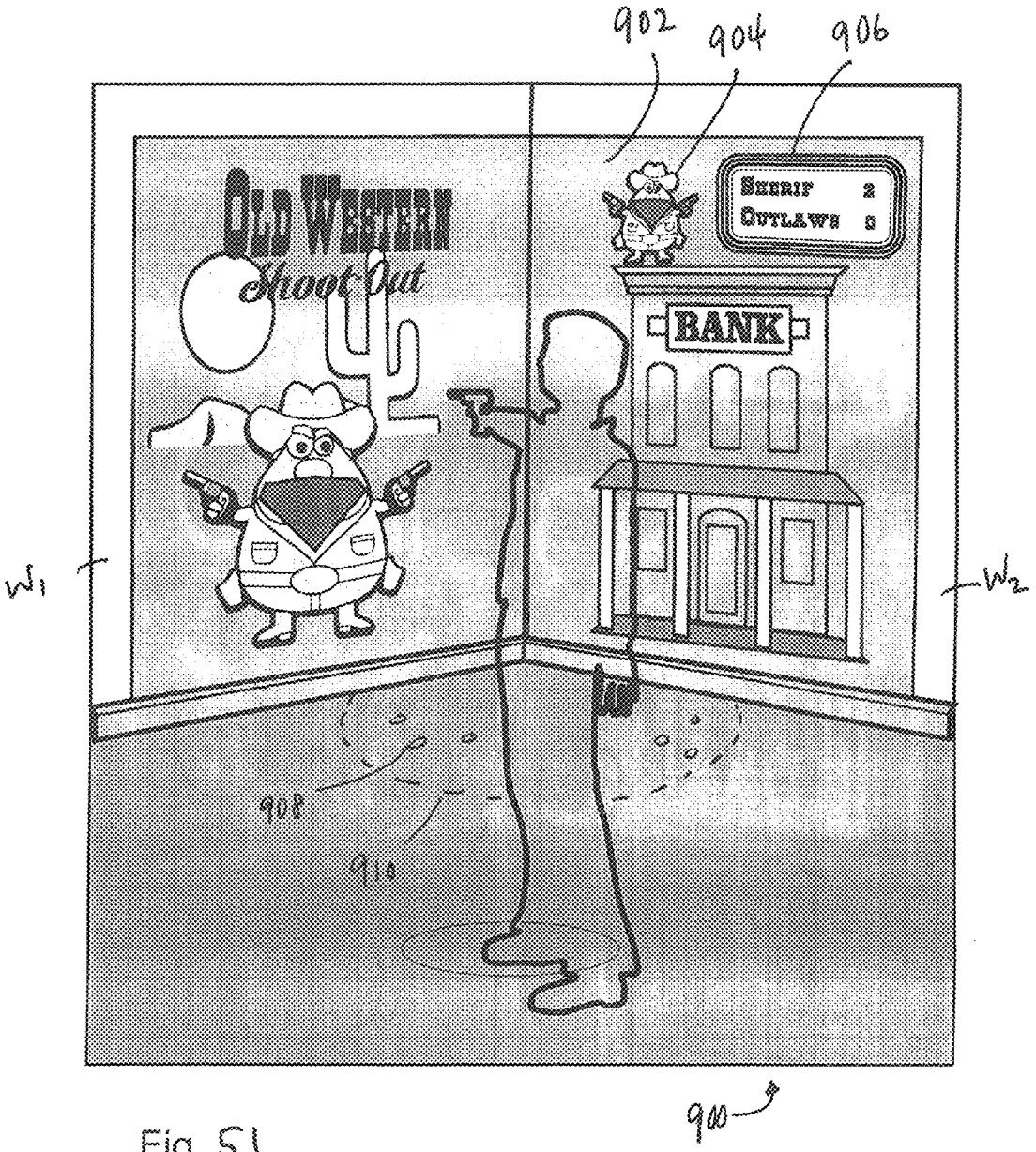
FIG. 51 is a front elevation view of an alternative embodiment of a target in accordance with the present invention, wherein the target may include a corner of a room.
Figure 52:
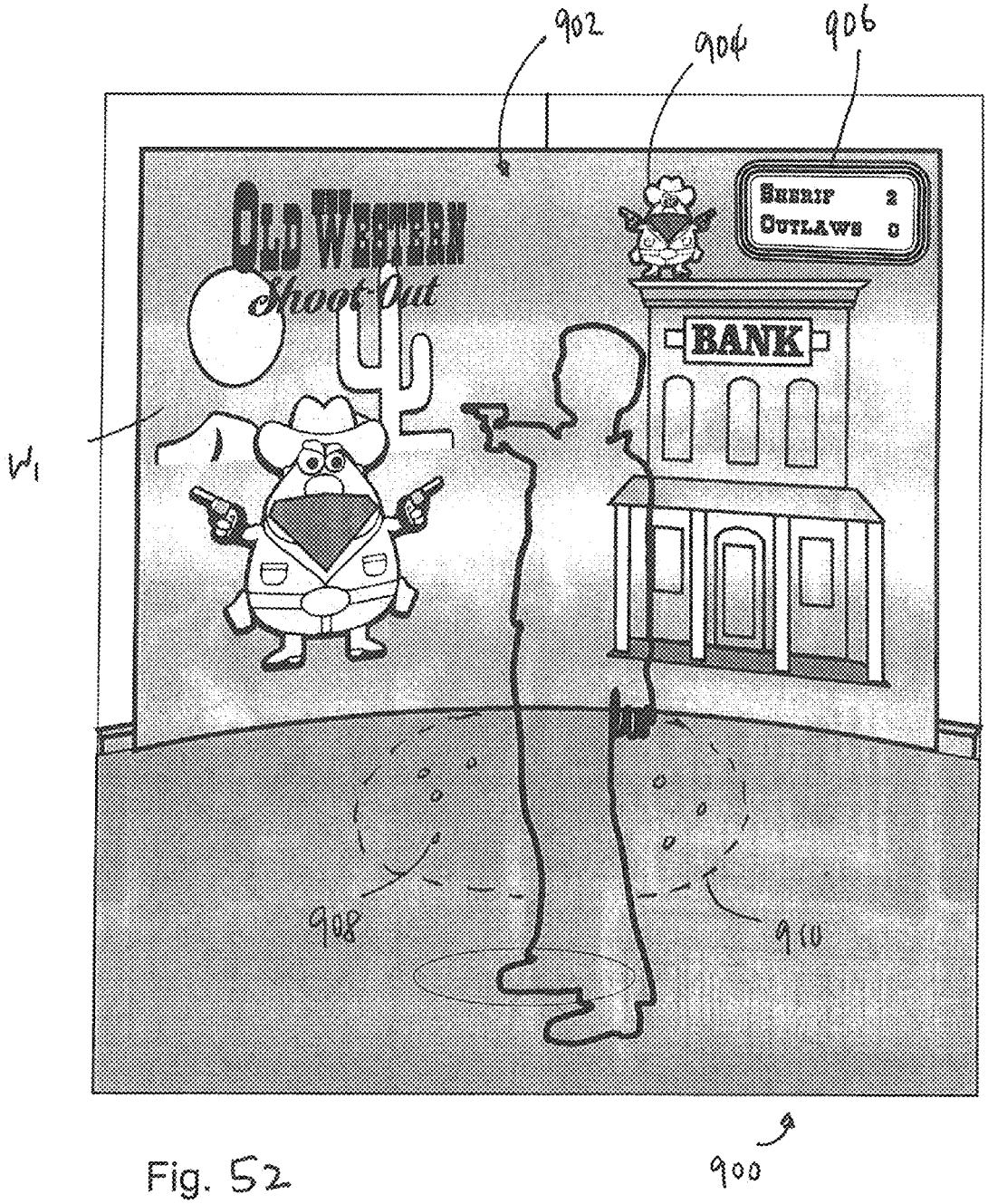
FIG. 52 is a front elevation view of a target of FIG. 51, wherein the target may include a curved wall.

The corner-mounted target configuration of the present invention may also be integrated into or mounted flush to one or more wall surfaces as shown in FIGS. 51-52. In this embodiment a target 900 comprises a wall graphics 902. The wall graphics may be formed of a mural affixed to the wall, a projected image, or of a digital video surface such as an organic electro-luminescence display such as an OLED. Some or a portion of the wall graphics 902 may capable of displaying both a target area 904 and a score keeping area 906. In one embodiment, the digital surface may be pressure sensitive to receive feedback from contact with projectiles 908. In an alternative embodiment the location of a projectile 908 may be located by an external sensor such as a video camera or visual sensor (not shown). The orientation of the target 900, in either a corner as shown in FIG. 51 or a curved wall in FIG. 52, will limit projectile ricochet to a drop zone or area 910 near the center of the wall graphic 902. The wall graphics may be player-type graphics that relate to the type of sport to which the target relates, such as football, basketball, soccer, baseball, etc., or may simply provide a backdrop or environment for the target. Furthermore, the target 900 may be applied over two walls W1, W2, or a single curved wall W1.

Figure 53:
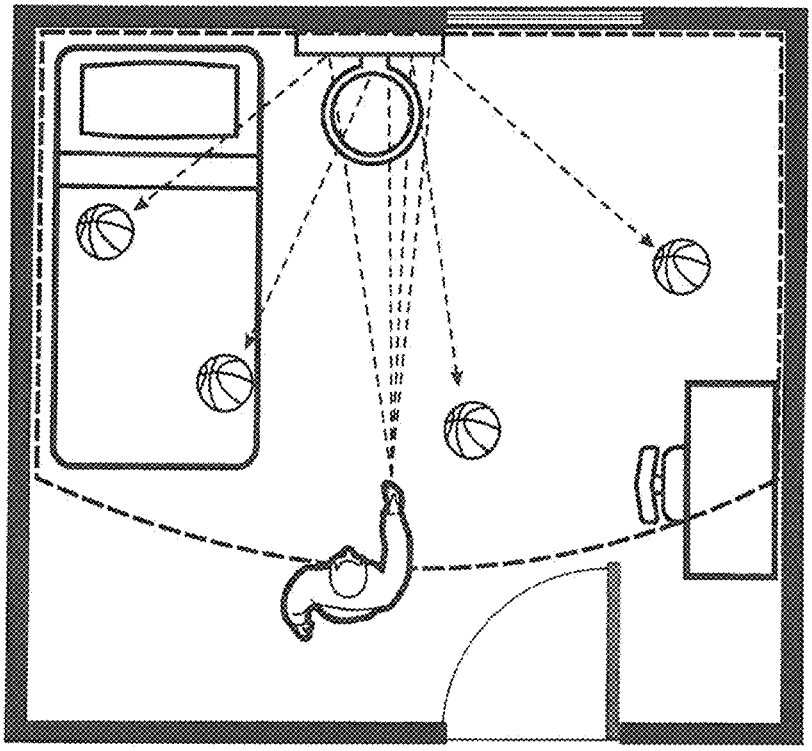
FIG. 53 is a top plan view of a room including a wall mounted target.
Figure 54:
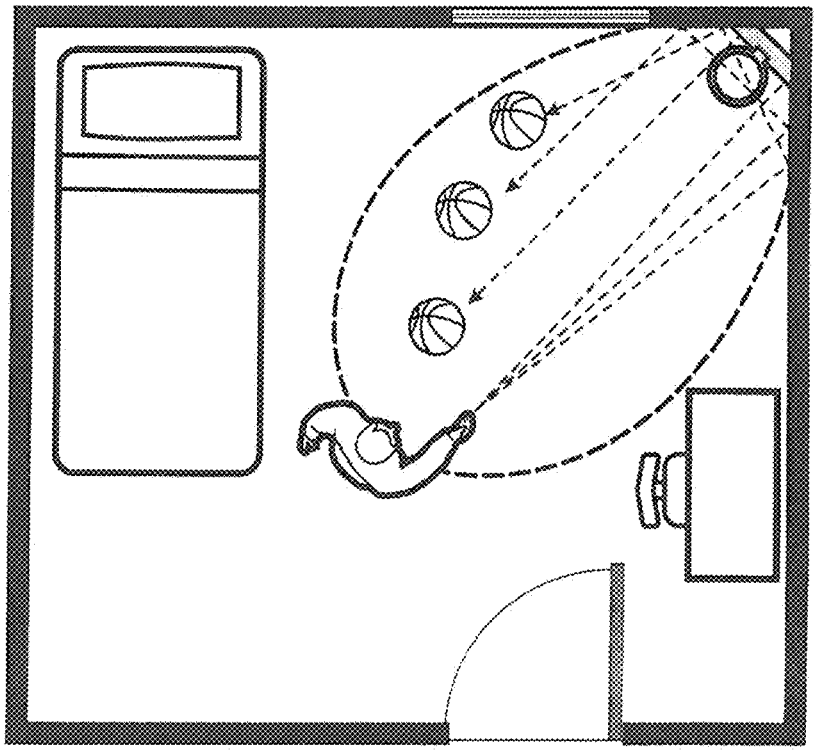
FIG. 54 is a top plan view of room including a corner mounted target in accordance with the present invention.
Figure 55:
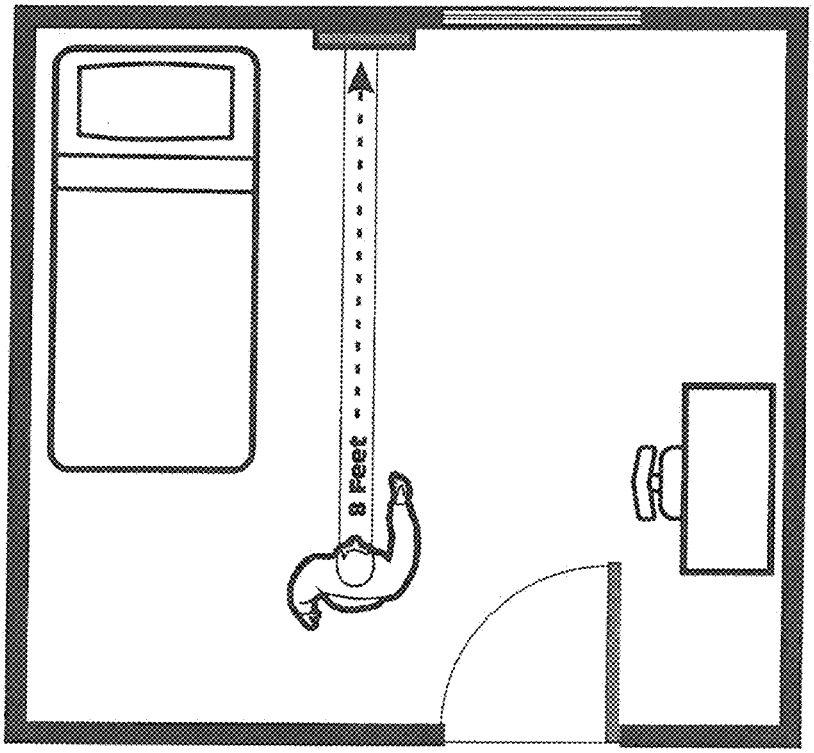
FIG. 55 is a top plan view of a room including a wall mounted target.
Figure 56:
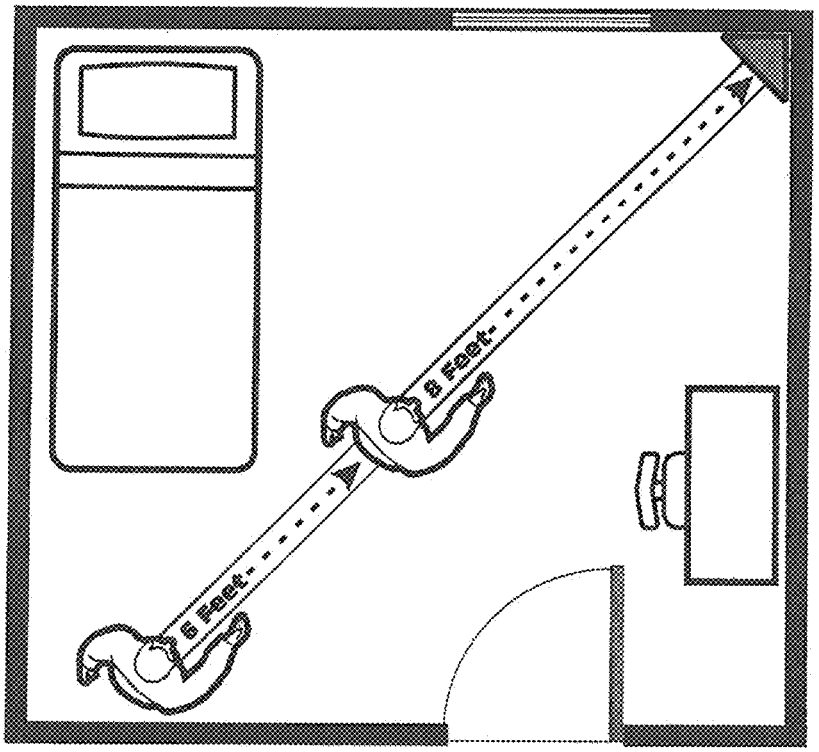
FIG. 56 is a top plan view of room including a corner mounted target in accordance with the present invention.
Figure 57:
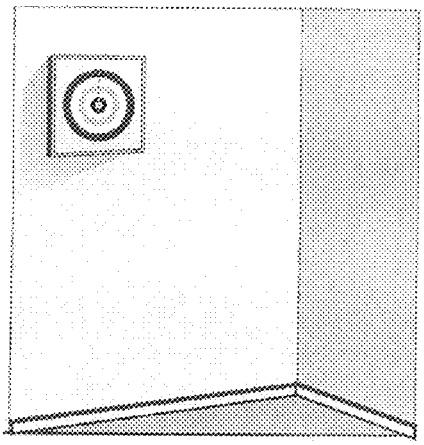
FIG. 57 is a front isometric view of a wall mounted target.
Figure 58:
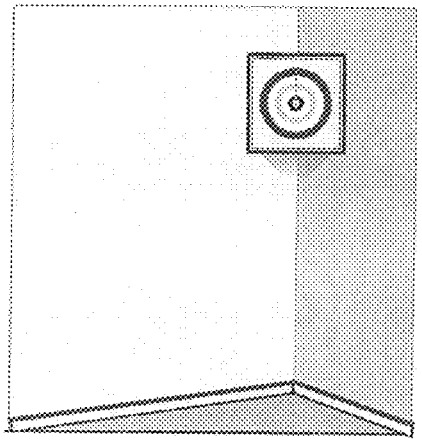
FIG. 58 is a front elevation view of a corner mounted target.
Figure 59:
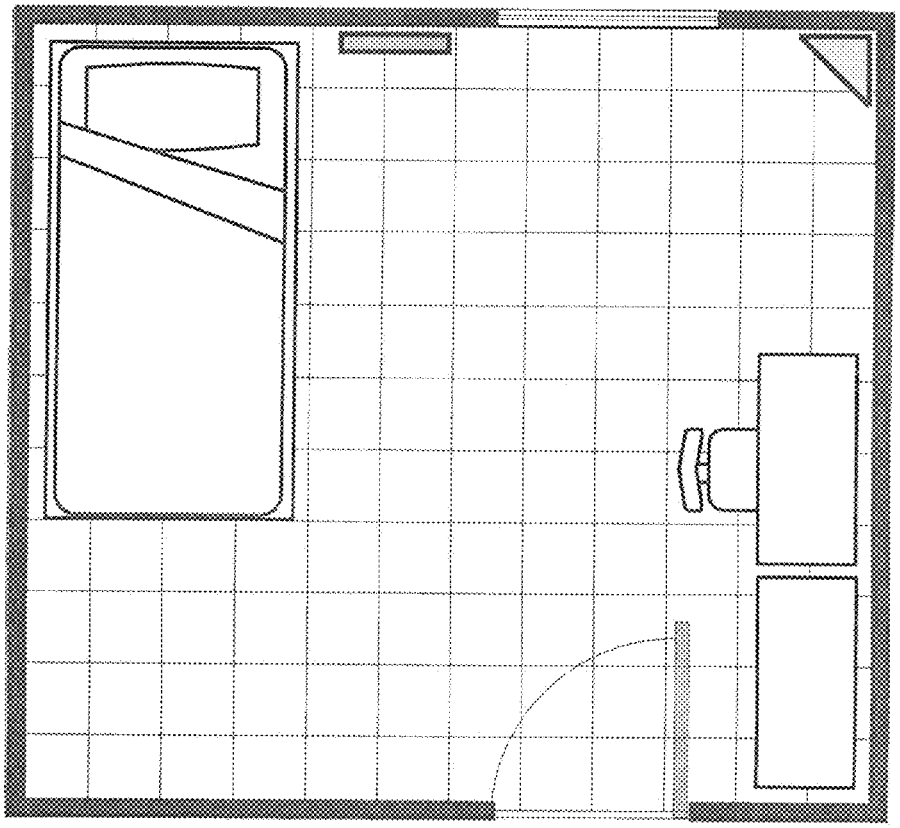
FIG. 59 is a top plan view of room including a wall mounted target and corner mounted target.

As illustrated in FIG. 54, the corner-mount target configurations of the present invention take advantage of the surrounding wall areas of the target to provide a compact drop zone 920 for flying projectiles propelled at the target, as compared to a wall mounted target illustrated in FIG. 53. When the target is missed, the projectiles will bounce off one wall and then the other, which dissipates the energy of the projectile and forces it to fall relatively close to the corner. The corner mounted location of the target also increases the shooting range for a given room size and locates the target in a typically less obtrusive and conspicuous area of the room, as illustrated in FIG. 56 as compared to a wall mounted target illustrated in FIG. 55.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A method of playing a game, comprising the acts of:

providing a target having a front target wall defining a top edge, a bottom edge and a pair of spaced apart side edges extending between the top and bottom edges, wherein the front target wall includes a target area located above the bottom edge, below the top edge and between the side edges, and wherein the target further includes a side mounting member extending from each of the spaced apart side edges of the front target wall, wherein each of the side mounting members includes wall engagement means for engagement with one of the walls defining a corner of a room;

mounting the target in the corner of the room using the wall engagement means by securing the target in the corner of the room above a floor of the room so that the bottom edge of the front target wall is spaced above the floor and the target area of the target faces outwardly from the corner of the room, and propelling one or more projectiles at the target area of the target.

2. The method of claim 1, wherein the act of providing a target comprises providing the target with a bottom wall located between the side edges of the front target wall and below the target area.

3. The method of claim 2, wherein the act of providing the target comprises providing each side mounting member with a front edge connected to one of the side edges of the front target wall, and providing the side mounting members with rear edges and connecting the rear edges to each other.

4. The method of claim 3, wherein the act of connecting the rear edges to each other forms the side mounting members and the front target wall so as to define an isosceles triangle configuration when viewed in plan view.

5. The method of claim 3, wherein the act of providing the target comprises connecting the front target wall and the side mounting members to define an interior, and wherein the bottom wall defines a lower extent of the interior.

6. The method of claim 1, wherein the act of providing a target comprises providing the target with the target area of the front target wall in the form of an opening in the front wall.

7. The method of claim 6, wherein the act of providing the target comprises providing the target with a bottom wall located between the side edges of the front target wall and below the target area, and a return opening in the front target wall located below the target opening and above the bottom wall.

8. The method of claim 1, wherein the act of providing a target comprises providing the target with a bottom wall located between the side edges of the front target wall and below the target area, and securing the front target wall, the side mounting members and the bottom wall together via fold lines formed in a blank of material.

9. The method of claim 1, wherein the act of providing a target comprises providing the target with a target area of the front target wall in the form of an opening in the front target wall and a target portion located within the opening.

10. The method of claim 9, wherein the act of providing the target includes providing the target in which the target portion is suspended within the opening.

* * * * *